US007074539B2

(12) United States Patent
Shibata et al.

(10) Patent No.: US 7,074,539 B2
(45) Date of Patent: Jul. 11, 2006

(54) ORGANIC PHOTORECEPTOR AND IMAGE FORMING METHOD

(75) Inventors: Toyoko Shibata, Tokyo (JP); Naoto Abe, Tokyo (JP); Akihiko Itami, Tokyo (JP); Takeo Oshiba, Tokyo (JP)

(73) Assignee: Konica Corporation, Tokyo (JP)

( * ) Notice: Subject to any disclaimer, the term of this patent is extended or adjusted under 35 U.S.C. 154(b) by 58 days.

(21) Appl. No.: 10/925,642

(22) Filed: Aug. 25, 2004

(65) Prior Publication Data

US 2005/0037273 A1 Feb. 17, 2005

Related U.S. Application Data

(62) Division of application No. 10/321,012, filed on Dec. 17, 2002.

(30) Foreign Application Priority Data

Dec. 27, 2001 (JP) ..... P2001-0396739
Mar. 27, 2002 (JP) ..... P2002-0088393

(51) Int. Cl.
*G03G 15/20* (2006.01)

(52) U.S. Cl. ..... 430/124; 399/309; 399/364; 430/126

(58) Field of Classification Search ..... 430/124, 430/58.05, 126; 399/309, 364
See application file for complete search history.

(56) References Cited

U.S. PATENT DOCUMENTS 5,604,063 A * 2/1997 Endo et al. ..... 430/58.4
5,952,142 A * 9/1999 Derks et al. ..... 430/83
5,955,229 A * 9/1999 Saita ..... 430/58.2
6,018,640 A * 1/2000 Blackman et al. ..... 399/364
6,150,065 A * 11/2000 Kobayashi et al. ..... 430/83
6,296,980 B1 * 10/2001 Oshiba et al. ..... 430/110.3

OTHER PUBLICATIONS

Borsenberger, Paul M. et al. Organic Photoreceptors for Imaging Systems. New York: Marcel-Dekker, Inc. (1993) pp. 6-17.*

* cited by examiner

*Primary Examiner*—Christopher Rodee
(74) *Attorney, Agent, or Firm*—Lucas & Mercanti

(57) ABSTRACT

An electrophotographic photoreceptor is disclosed. The charge transport material comprising a mixture of stereoisomers as a charge transport material and glass transition point Tgb of the binder resin of the charge transport layer and glass transition point Tgl of the charge transport layer satisfy $$100^\circ\ C. < Tgl1 < Tgb \text{(both } Tgb \text{ and } Tgl \text{ in } ^\circ C.).$$

An image forming method employing the photoreceptor is also disclosed.

13 Claims, 4 Drawing Sheets

FIG. 2 ( a )
TONER HAVING NO CORNERS
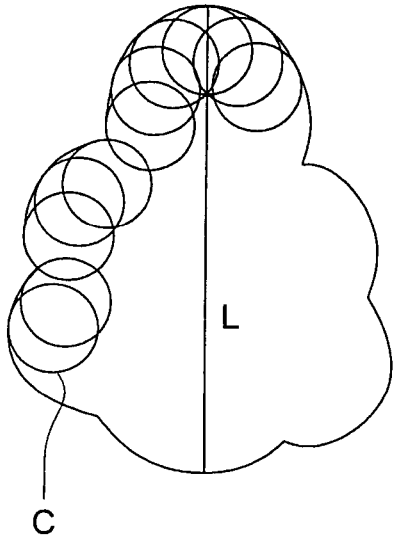
FIG. 2 ( b )
TONER HAVING CORNERS
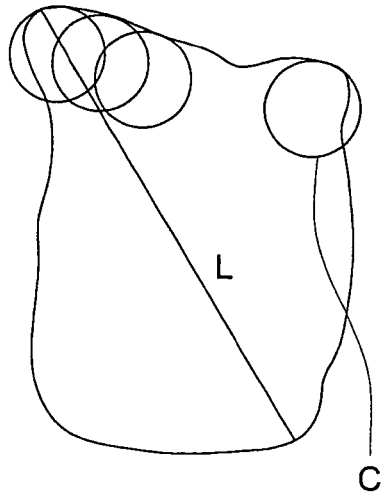
FIG. 2 ( c )
TONER HAVING CORNERS
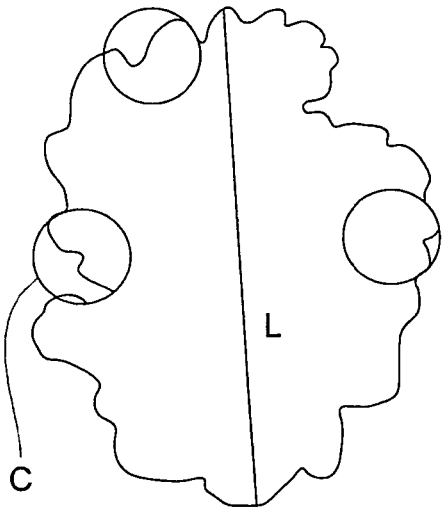

FIG. 5 ( a )
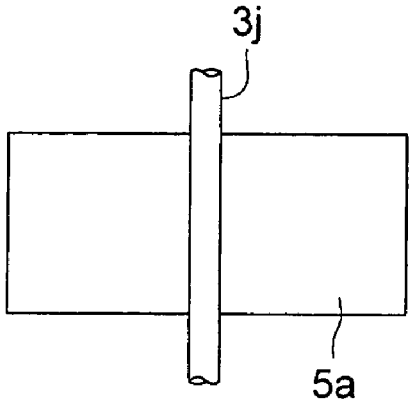
FIG. 5 ( b )
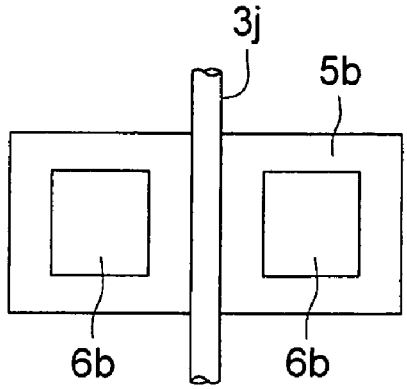
FIG. 5 ( c )
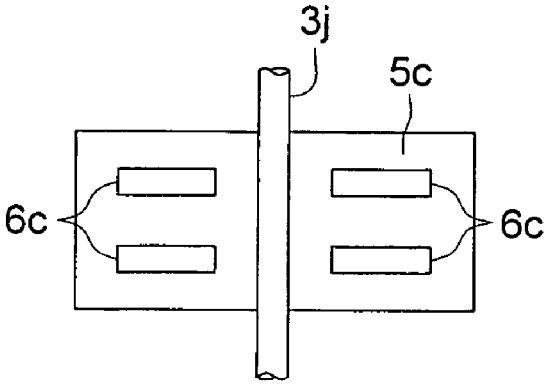
FIG. 5 ( d )
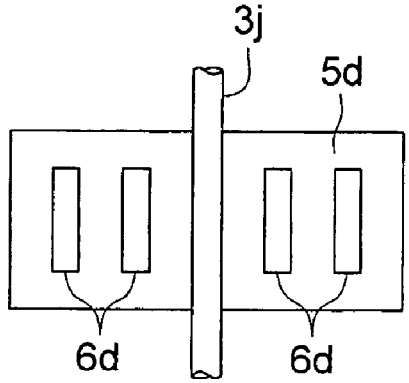

ORGANIC PHOTORECEPTOR AND IMAGE FORMING METHOD

CROSS REFERENCE TO RELATED APPLICATIONS

This is a Divisional Application of U.S. patent application Ser. No. 10/321,012, filed Dec. 17, 2002.

FIELD OF THE INVENTION

The present invention relates to an organic photoreceptor employed in the field of copiers and printers, and an image forming method, an image forming apparatus, and a processing cartridge using the same.

BACKGROUND OF THE INVENTION

With regard to electrophotographic photoreceptors, organic photoreceptors, which exhibit advantages in environmental protection as well as ease of production, have been mainly employed instead of inorganic photoreceptors. Currently, organic photoreceptors, utilizing various materials, have been developed.

In recent years, separate function type photoreceptors have played the main role in which charge generation and charge transport function employ different materials. Of these, laminated-layer type organic photoreceptors (hereinafter occasionally referred to simply as photoreceptors) are widely employed in which a charge generating layer and a charge transport layer are laminated to each other.

Further, when attention is paid to electrophotographic processes, techniques are directed from analogue image formation, employing halogen lamps as a light source, to digital system image formation, employing LED as well as lasers as a light source, due to ease of image processing as well as ease of application in composite machines.

The feature of such digitals copiers is a function which produces copies, utilizing electronic data. Due to that, it is possible to employ digital copiers as printers. Listed as image forming methods in such digital copiers are the following methods. Original document images of several pages are read employing imaging elements such as CCD; the resulting image data (hereinafter occasionally referred to as an electronic image) are stored in memory; image data are read from said memory; and images are formed onto recording paper (referring to final image recording paper and image supports such as transparent sheets).

In addition, another feature of digital copiers is that it is possible to use a so-called electronic RHD (Recirculating Document Handler) due to electronic capability of printing on both sides, as disclosed in Japanese Patent Open to Public Inspection No. 2001-147547. Since the electronic RDH makes it possible to electronically print both sides, it is unnecessary to store recording paper sheets which are printed on one side, being different from the double sided printing system employed in conventional copiers, whereby it is possible to continuously print one side and then the other side of recording paper sheets. Namely, a latent image is digitally formed and a toner image is then formed on a photoreceptor. The toner image is transferred onto one side of a recording paper sheet and fixed. Immediately after passing through the fixing process, the resulting recording paper is transported to the transfer and fixing process for the other side. As a result, when thermal fixing is employed, the recording paper sheet, heated at relatively high temperatures, is transported to the transfer and fixing process for printing on the other side, immediately after passing the fixing process. In such a case, the temperature in the interior of the apparatus increases due to heat retained by the recording paper. Subsequently the temperature of the photoreceptor increases. As a result, problems in terms of images tend to surface, which do not occur at room temperatures.

In image formation utilizing the digital system, reversal development is generally performed in which an exposed portion is subjected to a toner image. In reversal development, black spots which are peculiar to reversal development tend to be visualized when the temperature of the photoreceptor increases. The organic photoreceptor generally comprises an electrically conductive support having thereon a laminated layer structure comprised of an interlayer, a charge generating layer, and a charge transport layer. In order to overcome the black spot problem, techniques have been developed which minimize the injection of charge carriers from the electrically conductive layer to the interlayer. For example, an electrophotographic photoreceptor is known having a structure in which an interlayer is provided between the electrically conductive layer and the photosensitive layer, and in that interlayer, titanium oxide particles are dispersed in the resins. Further, also known is an interlayer in which surface-treated titanium oxide is incorporated. For example, organic photoreceptors are proposed which comprise an interlayer in which titanium oxide, which is subjected to a surface treatment employing iron oxide and tungsten oxide as disclosed in Japanese Patent Open to Public Inspection No. 4-303846, titanium oxide which is subjected to a surface treatment employing amino group containing coupling agents as disclosed in Japanese Patent Open to Public Inspection No. 9-96916, titanium oxide which is subjected to a surface treatment employing organic silicon compounds as disclosed in Japanese Patent Open to Public Inspection No. 9-258469, titanium oxide which is subjected to a surface treatment employing methylhydrogenpolysiloxane as disclosed in Japanese Patent Open to Public Inspection No. 8-328283, and dendritic titanium oxide which is subjected to a surface treatment employing metal oxides or organic compounds as disclosed in Japanese Patent Open to Public Inspection No. 11-344826, are incorporated.

However, at an ambience of high temperature and high humidity, generation of black spots is not sufficiently minimized. Alternatively, an increase in residual potential as well as an increase in potential in the exposed portion occurs during repeated use. As a result, problems occur in which it is difficult to achieved sufficient image density.

At an ambience of high temperature and high humidify, when black spots are minimized by increasing insulation of the interlayer, so that the transfer of free carriers from the electrically conductive support to the photosensitive layer is minimized, problems are noticed in which, contrary to the black spots, other image defects, called undeveloped spots, tend to occur. The undeveloped spots, as described herein, refer to image defects such as undeveloped spots or streaks in halftones or black solid images formed by reversal development. It is assumed that the phenomena occur in such a manner that during latent image formation on an organic photoreceptor, minute spots, in which charges are not eliminated, are formed in the area which is subjected to image exposure, and are the reverse phenomena with respect to the aforesaid black spots. In the image forming apparatus utilizing such a photoreceptor, image problems occur such as black spots on white backgrounds and white undeveloped spots on black backgrounds or halftones, which are not compatible with each other. Accordingly, it has been demanded to develop organic photoreceptors which overcome both such image problems.

Original image is frequently prepared in addition to the copy image preparation, and higher quality of images are required in the digital type electrophotography.

An image forming method employing a polymerization toner is proposed for an example of technique to obtain higher image as disclosed in Japanese Patent Open to Public Inspection No. 2000-214629. The polymerization toner has spherical shape and it has greater adhesive force to a photoreceptor, and therefore, induces a problems such as reducing transferring characteristics to a image forming sheet from the photoreceptor or cleaning characteristics, whereby the sufficient image density is not expected and sometimes generates an image deficiency such as white spot mentioned above.

In order to simultaneously minimize the aforesaid black spots and white undeveloped spots, the inventors of the present invention noticed that conventional investigations, which had mainly been directed to the interlayer, were insufficient and conducted comprehensive investigations while including the charge generating layer through the charge transport layer other than the interlayer.

SUMMARY OF THE INVENTION

From the viewpoint of the aforesaid conventional technical problems, the present invention is to provide an organic photoconductor which exhibits excellent potential stability, as well as overcomes image problems such as black spots, white undeveloped spots, and cracks, even in an ambience of high temperature and high humidity, and more specifically to provide an organic photoreceptor which overcomes image problems such as black spots, white undeveloped spots, and cracks which tend to be formed when double sided images are formed by transferring toner images formed on the organic photoreceptor onto recording paper and subsequently fixed while employing an electric RDH, and minimizes potential variation, and an image forming method, an image forming apparatus, and a processing cartridge using the same.

The inventors of the present invention conducted investigations to solve the aforesaid problems. As a result, it was discovered that when double sided images were formed by transferring toner images formed on an photoreceptor onto recording paper and subsequently fixed, while employing an electronic RDH, in order to effectively minimize image problems such as black spots and white undeveloped spots even when the temperature around the photoreceptor became relatively high, it was necessary to prepare the charge transport layer with layer quality which was resistant against high temperature and high humidity, in addition to the conventional techniques applied to the interlayer. As a result, the present invention was achieved. Namely, the following were discovered. In an organic photoreceptor comprising an electrically conductive support having thereon a structure comprised of a charge generating layer, and a charge transport layer, by employing charge transport materials comprised of a mixture of stereoisomers and also increasing Tgl of the charge transport layer, the layer quality of the charge transport layer was not degraded even at high temperature so as to minimize formation of deep scars on the surface. At the same time, it was possible to effectively minimize the migration of electrons injected from the electrically conductive support. As a result, the present invention was achieved. Further, by employing a mixture of stereoisomers, it was possible to minimize formation of cracks which tended to occur at low temperature and low humidity when TGl of the charge transport layer increased.

The invention and its embodiment are described.

The organic photoreceptor comprises an electrically conductive support having thereon a charge generating layer, further thereon a charge transport layer. The charge transport layer comprises a charge transport material comprised of a mixture of stereoisomers as a charge transport material, and glass transition point Tgb of the binder resin of said charge transport layer and glass transition point Tgl of said charge transport layer satisfy the relationship described below.

$$100^\circ\ \text{C.} < Tgl < Tgb \text{(both } Tgb \text{ and } Tgl \text{ in } ^\circ\ \text{C.)}$$

The molecular weight of said charge transport material comprised of a mixture of stereoisomers is preferably from 600 to 1,500.

The content ratio of the isomer which occupies the greatest proportion in the mixture of stereoisomers is preferably from 40 to 90 percent by weight.

The charge transport layer preferably contains polycarbonate resin.

The organic photoreceptor preferably comprises an interlayer between an electrically conductive support and a charge generating layer.

The interlayer preferably comprise a binder resin in which minute inorganic particles are dispersed.

An image forming method in which double sided images are formed by transferring an image formed on an organic photoreceptor onto recording paper and fixed while employing an electronic RDH, wherein the organic photoreceptor comprising an electrically conductive support having thereon a charge generating layer and a charge transport layer, and said charge transport layer comprises a charge transport material comprised of a mixture of stereoisomers as a charge transport material, and glass transition point Tgb of the binder resin of said charge transport layer and glass transition point Tgl of said charge transport layer satisfy the relationship described below.

$$100^\circ\ \text{C.} < Tgl < Tgb \text{(both } Tgb \text{ and } Tgl \text{ in } ^\circ\ \text{C.)}$$

An image forming method for forming an image on both sides of a sheet, comprising:

forming a first toner image on a photoreceptor;

transferring the first toner image to a first side of a sheet;

fixing the first toner image on the sheet with a fixing device;

returning the sheet from the fixing device to the photoreceptor without stacking the sheet on an intermediate tray while forming a second toner image on the photoreceptor;

transferring the second toner image on the photoreceptor to a second side of the sheet;

fixing the second toner image on the sheet with the fixing device, wherein the photoreceptor comprising an electrically conductive support having thereon a charge generating layer and a charge transport layer, and the charge transport layer comprises a charge transport material comprising a mixture of stereoisomers as a charge transport material.

In the image forming method, fixing may be conducted by a thermal fixing device.

A processing cartridge which integrally comprises at least one of a charging unit, a development unit, a transfer electrode, and a cleaning device together with an organic photoreceptor, and is detachably mounted on an image forming apparatus.

The image forming method in which double sided images are formed by transferring an image formed on an organic photoreceptor onto recording paper and fixed while employing an electronic RDH, wherein the surface layer of said organic photoreceptor is a charge transport layer comprising charge transport material comprised of a mixture of stereoisomers, and toner, which is employed to form said toner image, has a variation coefficient of the shape factor of toner particles of at most 16 percent.

The image forming method in which double sided images are formed by transferring an image formed on an organic photoreceptor onto recording paper and fixed while employing an electronic RDH, wherein the surface layer of said organic photoreceptor is a charge transport layer comprising charge transport material comprised of a mixture of stereoisomers, and toner, which is employed to form said toner image, comprises toner particles having a shape coefficient in the range of 1.2 to 1.6 of 65 percent by number.

The image forming method in which double sided images are formed by transferring an image formed on an organic photoreceptor onto recording paper and fixed while employing an electronic RDH, wherein the surface layer of said organic photoreceptor is a charge transport layer comprising charge transport material comprised of a mixture of stereoisomers, and toner, which is employed to form said toner image, is comprised of toner particles without corners at a ratio of least 50 percent by number.

In the image forming method, the surface layer of said organic photoreceptor is a charge transport layer comprising charge transport material comprised of a mixture of stereoisomers, and a toner, which is employed to form said toner image, is such that sum M of $m_1$ and $m_2$ is at least 70 percent, wherein $m_1$ is the relative frequency of toner particles included in the highest frequency class in a histogram, showing the particle size distribution based on the number of particles, in which, when D (in μm) represents the diameter of a toner particle, natural logarithm lnD is taken as the abscissa and a plurality of classes at an interval of 0.23 is taken as the ordinate, and $m_2$ is the relative frequency of toner particles included in the second highest frequency class in said histogram.

In an image forming method in which double sided images are formed by transferring an image formed on an organic photoreceptor onto recording paper and fixed while employing an electronic RDH, wherein the surface layer of said organic photoreceptor is a charge transport layer comprising charge transport material comprised of a mixture of stereoisomers, and toner, which is employed to form said toner image, has a number variation coefficient of toner particles of at most 27 percent.

The image forming method, described above, wherein the content ratio of the isomer which occupies the greatest proportion in said mixture of stereoisomers is from 40 to 90 percent by weight.

The image forming method, described above, wherein said organic photoreceptor comprises an electrically conductive support having thereon a charge generating layer and a charge transport layer.

In the image forming method described above, the toner is preferably a polymerization toner.

In the image forming method described above, the number average particle diameter of the toner is preferably from 3.0 to 8.5 μm.

In an organic photoreceptor employed in an image forming method in which double sided images are formed by transferring an image formed on said organic photoreceptor onto recording paper and fixed while employing an electronic RDH, an organic photoreceptor wherein the surface layer of said organic photoreceptor is a charge transport layer comprising the charge transport material comprised of a mixture of stereoisomers.

BRIEF DESCRIPTION OF THE DRAWINGS

FIG. 2(*a*) is a view showing the projected image of a toner particle without corners, and FIGS. 2(*b*) and 2(*c*) are views showing the projected image of a toner particle with corners.

FIG. 5 is a schematic view showing specific examples of the shape of stirring blades.

DETAILED DESCRIPTION OF THE INVENTION

Figure 1:
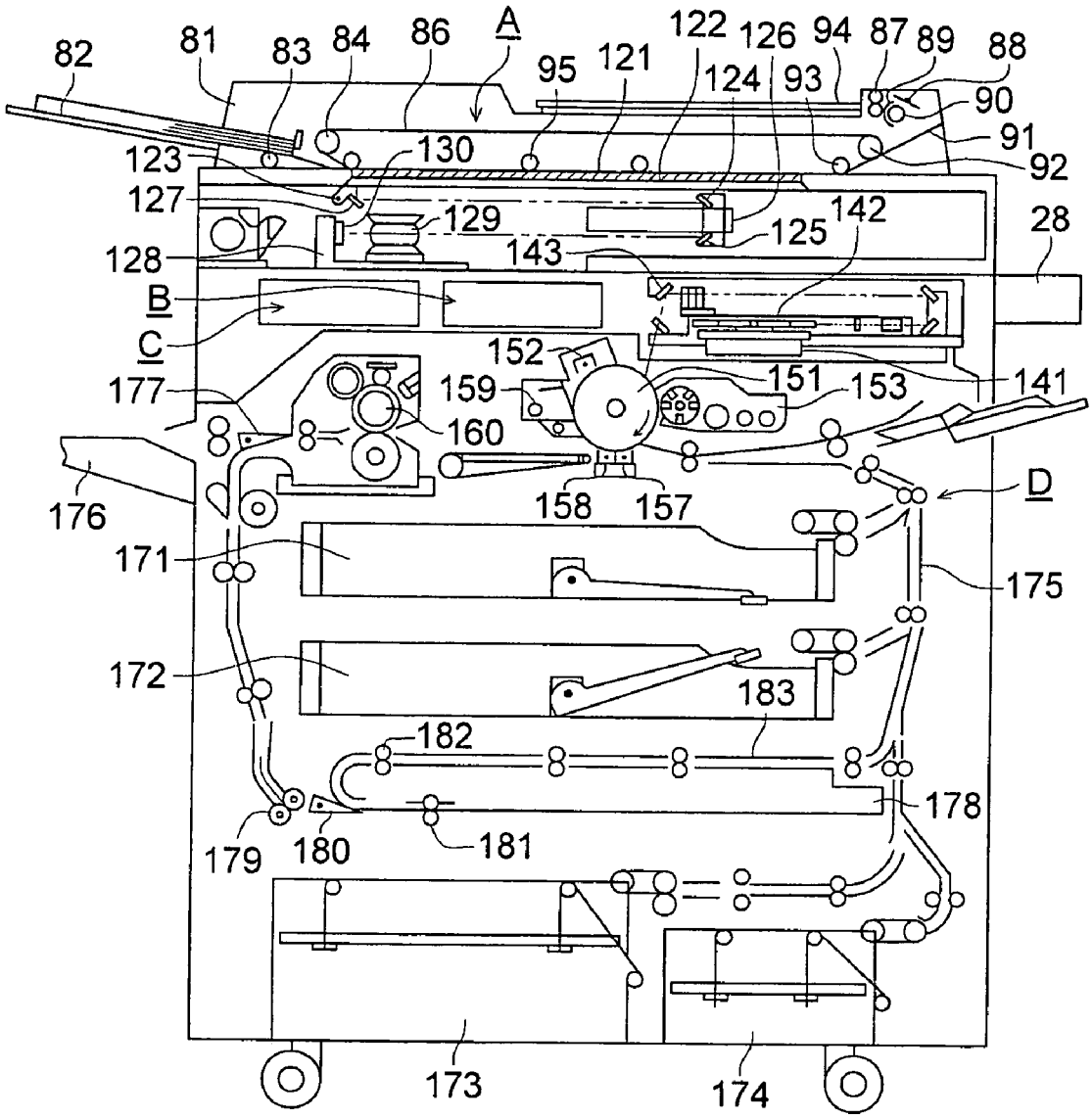
FIG. 1 is a view showing the entire constitution of an image forming apparatus (a digital copier) which can be suitably employed in an image forming method in which, employing the electronic RDH of the present invention, double sided images are formed by transferring a toner image formed on an organic photoreceptor onto recording paper and fixed thereon.

The organic photoreceptor of the present invention is one which comprises an electrically conductive support having thereon a charge generating layer, and further thereon a charge transport layer, and the charge transport layer comprises charge transport materials comprised of a mixture of stereoisomers as a charge transport material, and glass transition point Tgb of the binder resin of the charge transport layer and glass transition point Tgl of the charge transport layer satisfy the relationship described below.

$$100° \text{ C.} < Tgl < Tgb \text{ (both } Tgb \text{ and } Tgl \text{ in } ° \text{ C.)}$$

The organic photoconductor of the present invention is employed in the following double sided-image forming method. A first digital electrostatic latent image is formed on the organic photoreceptor based on image information which is converted to an electronic image. After converting the electrostatic latent image to a toner image, the resulting toner image is transferred onto one side of recording paper and fixed. Thereafter, without storage, the resulting recording paper is transported to the transfer and fixing processes for the other side, and a toner image based on a second electronic image formed on the aforesaid organic photoreceptor is transferred onto the resulting recording sheet and subsequently fixed. Namely, when the double sided-image forming method (hereinafter occasionally referred simply to as a double sided-image forming process employing an electronic RDH), in which while employing the electronic RDH of the present invention, images on both sides are formed by transferring a toner image formed on the photoreceptor to recording paper and fixing it, is applied, it more markedly achieves the purposes of the present invention.

Glass transition point Tgl of the charge transport layer of the organic photoreceptor varies depending on binder resins and charge transport materials, which are main components of the charger transfer layer and additives other than the charge transport materials. of course, the glass transition point is affected by concentration of residual solvents. The residual solvents often adversely affect the charging characteristics of organic photoreceptors, electrophotographic characteristics such as sensitivity, and physical properties of layers. Accordingly, it is preferable to remove the residual solvents to an amount as small as possible. Further, since the added amount of additives, other than the charge transports materials, is small compared to the charge transport materials, their effects on glass transition point Tgl is limited. In order to minimize degradation of physical properties of the charge transport layer, it is necessary to use additives (compounds which do not decrease glass transition point Tgl), while taking into account their amount and properties.

Conventional charge transport layers comprise charge transport materials in a large amount so as to transport charges generated in the charge transport layer onto the surface of the photoreceptor. Due to that, even though the amount of residual solvents, as well as the amount and quality of other additives are employed upon being adjusted, the glass transition point of the charge. transport layer does not exceeded 100° C.

In the present invention, by incorporating transport materials in a relatively low mol, developed was a charge transport layer which resulted in a minimal decrease in charge transport capability, as well as a minimal decrease in glass transition point Tgl.

By allowing the charge transports layer to exhibit a glass transition point of at least 100° C. so as to minimize degradation of the layer properties of the charge transport layer, it is possible to prepare organic photoreceptors in which image problems such as white undeveloped spots as well as black spots, are overcome, and which also exhibit excellent electrophotographic characteristics such as chargeability as well as sensitivity. By employing charge transport materials comprising a mixture of stereoisomers in an amount of several mol, such as $2.0\times10^{-4}$ to $7.0\times10^{-4}$ mol per g of the charge transport layer, it is possible to minimize the magnitude of decrease (the magnitude of decrease from the glass transition point Tgb of the binder resin).

By employing charge transport materials comprised of a mixture of stereoisomers in low mol, prepared are photoreceptors which minimize degradation of physical properties of the charge transport layer at high temperature and high humidity, effectively overcome image problems such as black spots as well as white undeveloped spots during reversal development, and further exhibit excellent electrophotographic characteristics. Further, as the Tg of the charge transport layer increases, the resulting layer becomes brittle, whereby cracks (cracking formed through contact with the cleaning roller and the cleaning blade) tend to form at low temperature and low humidity. However, a charge transport layer comprising charge transport materials comprised of a mixture of stereoisomers tends not to result in the formation of the cracks, even though its Tg exceeds 100° C.

In order to achieve sufficient stability of electrophotographic characteristics and desired compatibility with binder resins, the content ratio of the stereoisomer component in the maximal amount among stereoisomers is preferably from 40 to 90 percent by weight. In order to achieve sufficient electrophotographic characteristics and desired compatibility with binders, the molecular weight of the transport materials comprised of stereoisomers is preferably from 600 to 1,500.

Preferred as binder resins of the charge transport layer are polycarbonate resins which exhibit both excellent electrophotographic characteristics and excellent physical layer properties. Polycarbonate, as described herein, refers to polymers having a polycarbonate structure, (—OCOO—).

Glass transition point Tg of polycarbonate resins varies depending on the resin structure and the molecular weight, but the molecular weight of commercially available polycarbonate resins is usually from about 160 to about 200° C. Due to that, when polycarbonate resins are employed as a binder resin of the charge transport layer, the magnitude of decrease (from the binder resins) in the glass transition point of the charge transport layer, due to charge transport materials and other additives, is at most 100° C. and is preferably from 30 to 60° C. When the magnitude of decrease in the glass transition point is less than 30° C., the charge transportability of the charge transport layer tends to become insufficient.

The molecular weight of charge transport materials having a stereoisomeric structure is preferably from 500 to 1,500. By employing charge transport materials having such high molecular weight, it is possible to enhance the layer quality of the charge transport layer, resulting in marked effects of the present invention.

By employing charge transport materials having a high molecular weight as described above, which are mixtures of stereoisomers, prepared are photoreceptors with minimal degradation of physical properties of the charge transport layer at high temperature and high humidity, effectively overcoming image problems such as black spots as well as white undeveloped spots during reversal development, and further exhibiting excellent electrophotographic characteristics.

The charge transport material comprised of a mixture of stereoisomers, as described herein, refers to compounds having an isomeric structure which is formed by differing configuration of atoms or groups of atoms in the compound of the charge transport material, and specifically refers to charge transport materials exhibiting geometrical isomerism having a double bond between carbon atoms.

Preferred as charge transport materials comprised of a mixture of stereoisomers are bis(arylethenylphenyl)aniline based compounds or bis- or tributadiene based compounds.

(Arylethenylphenyl)aniline based compounds, as described in the present invention, refer to a group of compounds having two arylethenylphenyl groups on the nitrogen atom of aniline. Compounds which are represented by General Formula (1), described below, are preferred. Further, as shown by General Formulas (2) through (6), preferred are those having either an alkyl group or an alkoxy group at the ortho or para position of the aniline group.

General Formula (1)

General Formula (1)

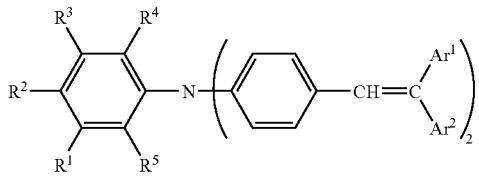

In General Formula (1), $R^1$, $R^2$, $R^3$, $R^4$, $R^5$ each represents a hydrogen atom and an alkyl group or an alkoxy group, having from 1 to 4 carbon atoms, $Ar^1$ represents a hydrogen atom, or a substituted or unsubstituted aromatic group, and $Ar^2$ represents a substituted or unsubstituted aromatic group which differs from $Ar^1$.

General Formula (2)

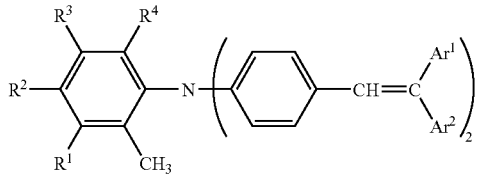

In General Formula (2), $R^1$, $R^2$, $R^3$, and $R^4$ each represents a hydrogen atom and an alkyl group or an alkoxy group, having from 1 to 4 carbon atoms, $Ar^1$ represents a hydrogen atom, or a substituted or unsubstituted aromatic group, and $Ar^2$ represents a substituted or unsubstituted aromatic group which differs from $Ar^1$.

General Formula (3)

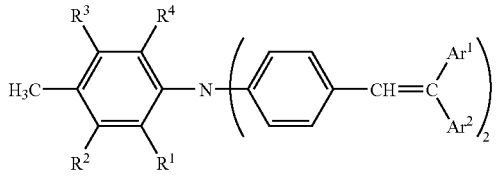

In General Formula (3), $R^1$, $R^2$, $R^3$, and $R^4$ each represents a hydrogen atom and an alkyl group or an alkoxy group, having from 1 to 4 carbon atoms, $Ar^1$ represents a hydrogen atom, or a substituted or unsubstituted aromatic group, and $Ar^2$ represents a substituted or unsubstituted aromatic group which differs from $Ar^1$.

General Formula (4)

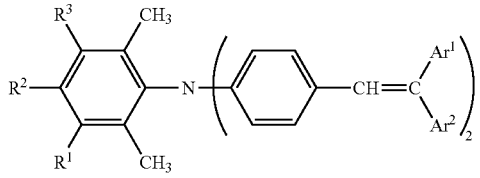

In General Formula (4), $R^1$, $R^2$, and $R^3$ each represents a hydrogen atom and an alkyl group or an alkoxy group, having from 1 to 4 carbon atoms, $Ar^1$ represents a hydrogen atom, or a substituted or unsubstituted aromatic group, and $Ar^2$ represents a substituted or unsubstituted aromatic group which differs from $Ar^1$.

General Formula (5)

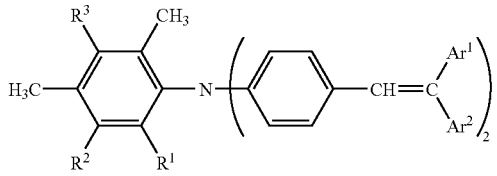

In General Formula (5), $R^1$, $R^2$, and $R^3$ each represents a hydrogen atom and an alkyl group or an alkoxy group, having from 1 to 4 carbon atoms, $Ar^1$ represents a hydrogen atom, or a substituted or unsubstituted aromatic group, and $Ar^2$ represents a substituted or unsubstituted aromatic group which differs from $Ar^1$.

General Formula (6)

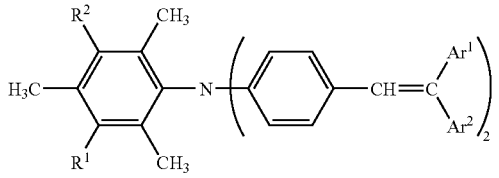

In General Formula (6), $R^1$ and $R^2$ each represents a hydrogen atom and an alkyl group or an alkoxy group, having from 1 to 4 carbon atoms, $Ar^1$ represents a hydrogen atom, or a substituted or unsubstituted aromatic group, and $Ar^2$ represents a substituted or unsubstituted aromatic group which differs from $Ar^1$.

Further, the substituted or unsubstituted aromatic group represented by $Ar^1$ and $Ar^2$ in General Formulas (1) through (6) is preferably represented by General Formula (7) described below.

General Formula (7)

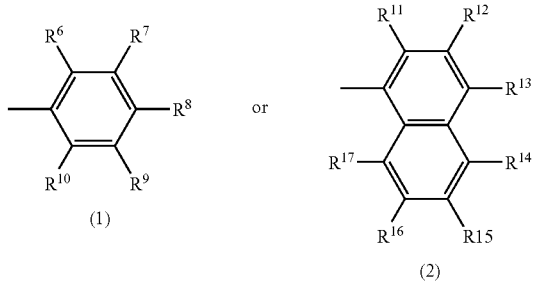

In General Formula (7), $R^6$ through $R^{17}$ each represents a hydrogen atom, an alkyl group having from 1 to 4 carbon atoms, an alkoxy group, a halogenated alkyl group, a halogen atom or an alkoxy group having from 1 to 4 carbon atoms.

Examples of preferred bis(arylethenylphenyl)aniline based compounds are listed below. All of these compounds have a stereoisomeric structure.

T1

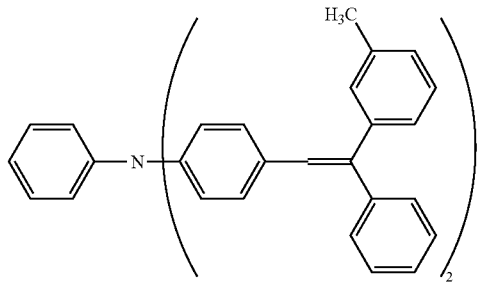

-continued
T2
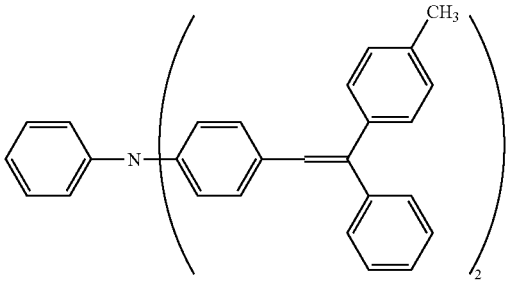
T3
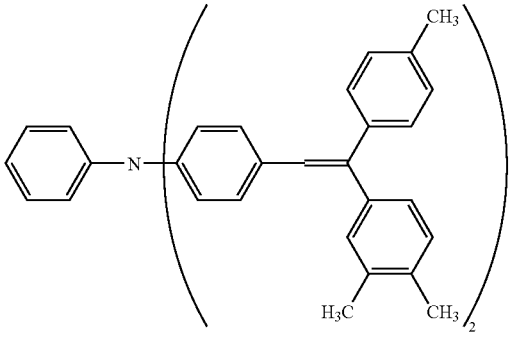
T4
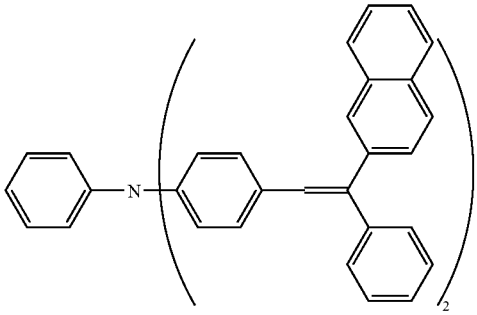
T5
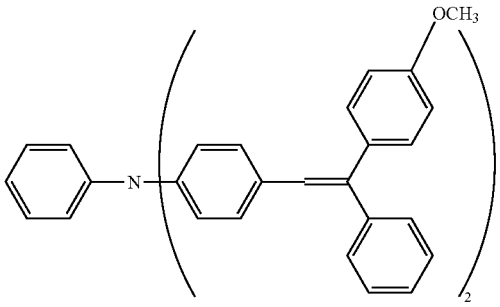
T6
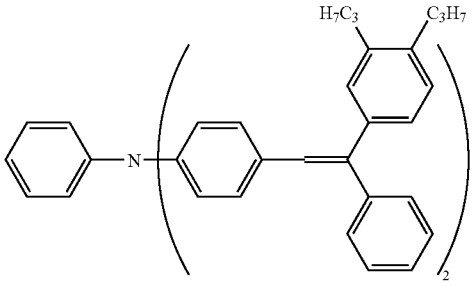
-continued
T7
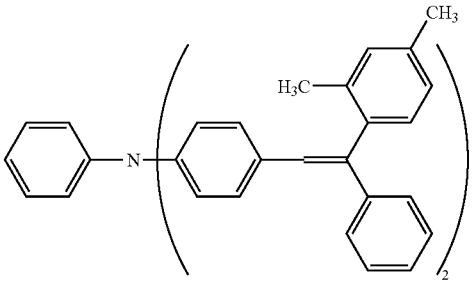
T8
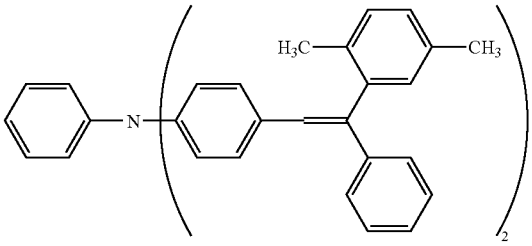
T9
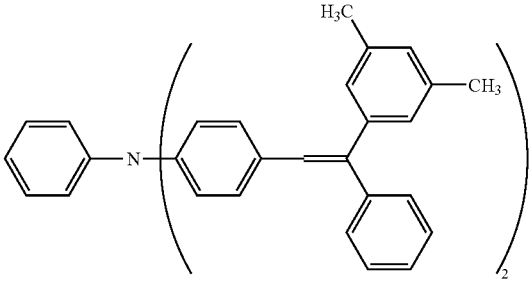
T10
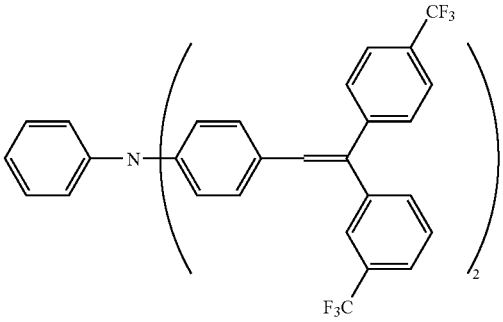
T11
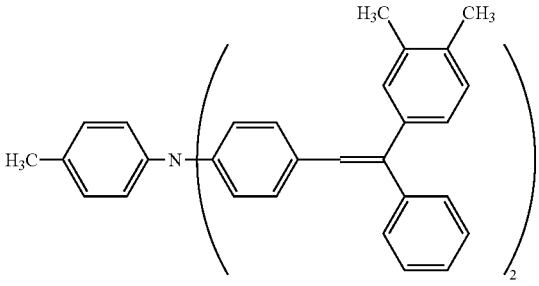

-continued
T12
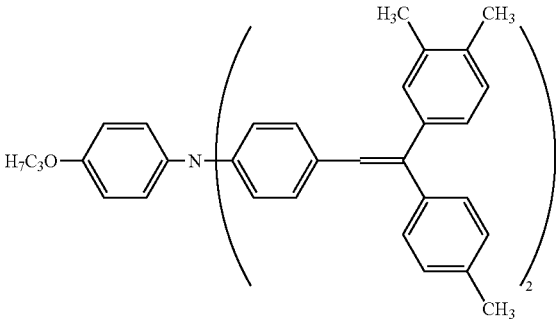
T13
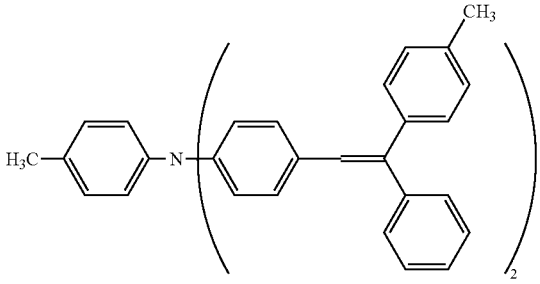
T14
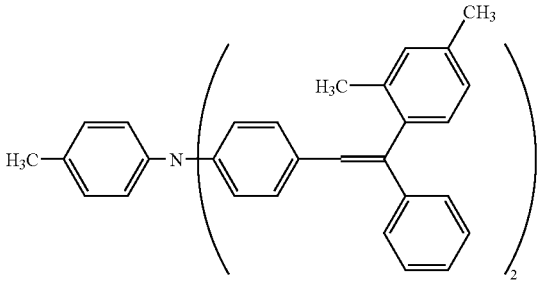
T15
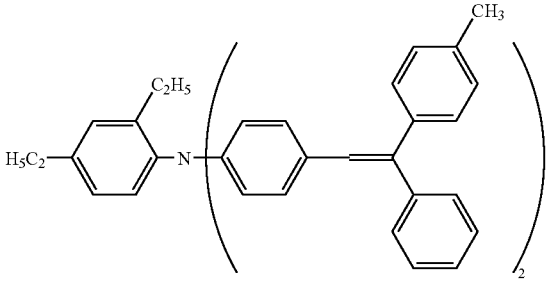
-continued
T16
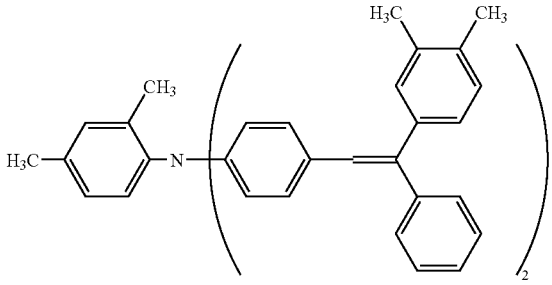
T17
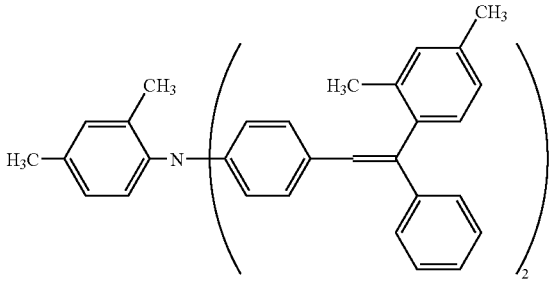
T18
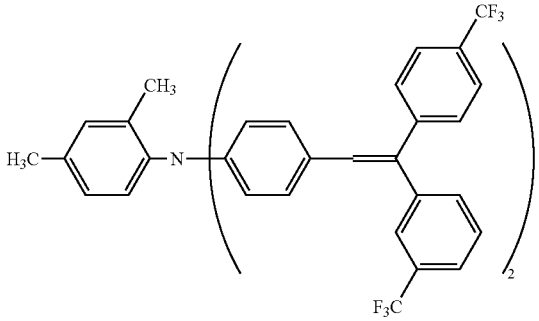
T19
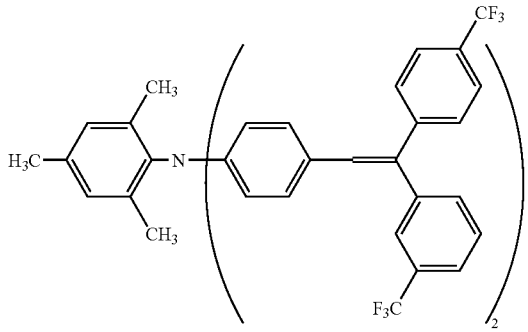

-continued
T20
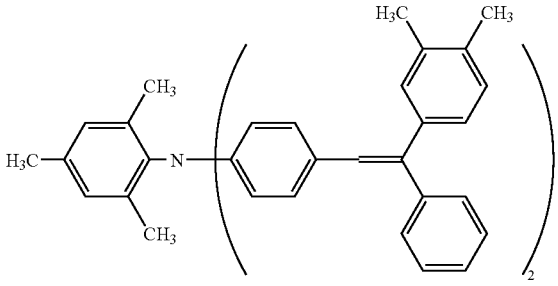
T21
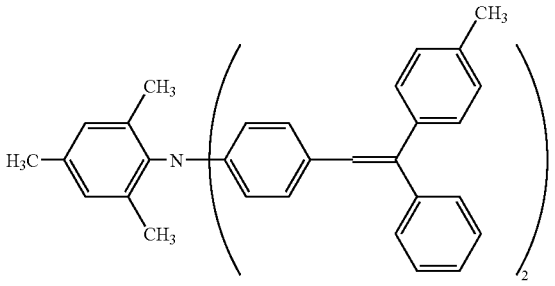
T22
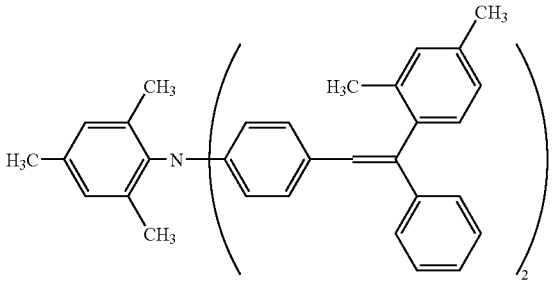
T23
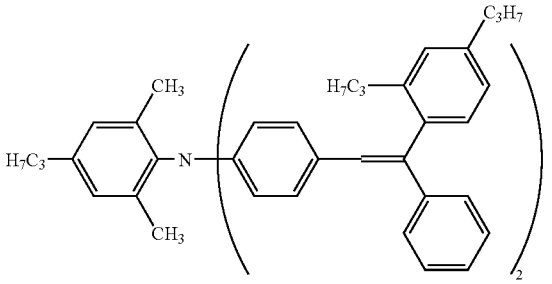
T24
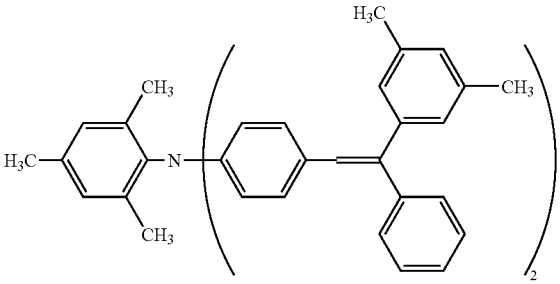
-continued
T25
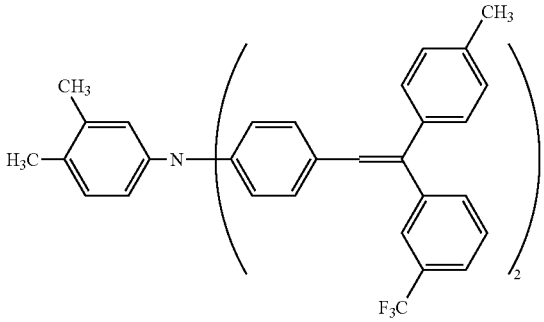
T26
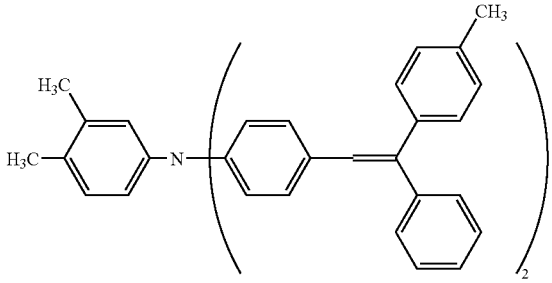
T27
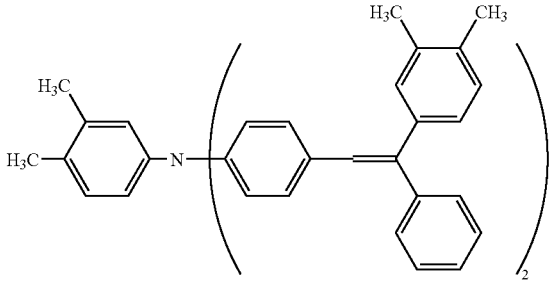
T28
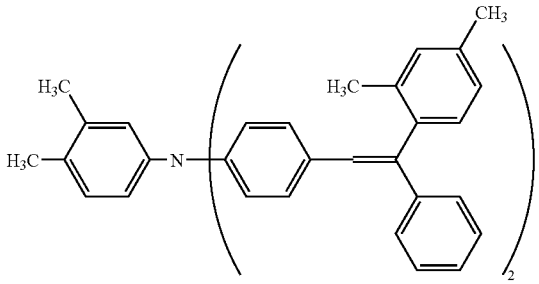
T29
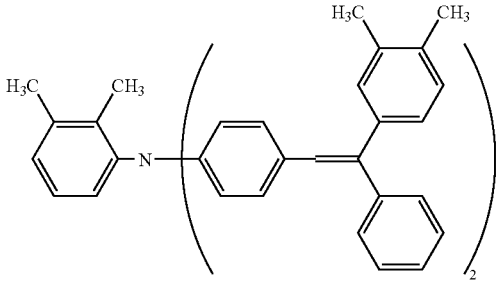

-continued
T30
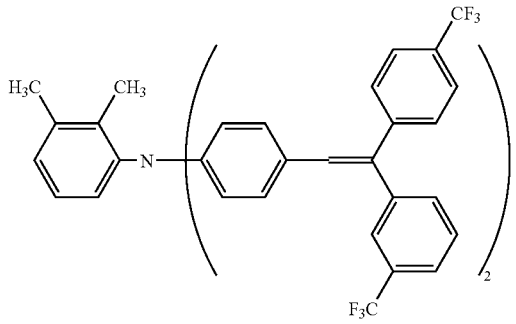
T31
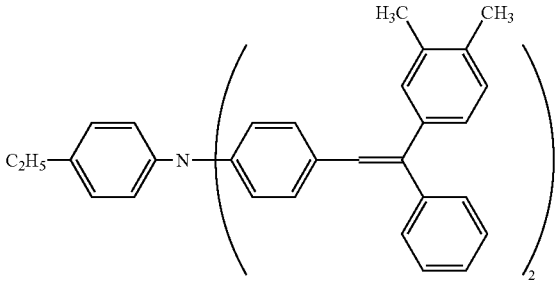
T32
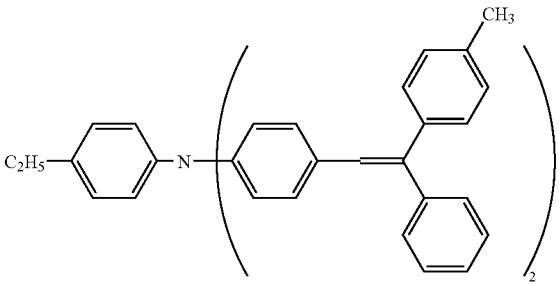
T33
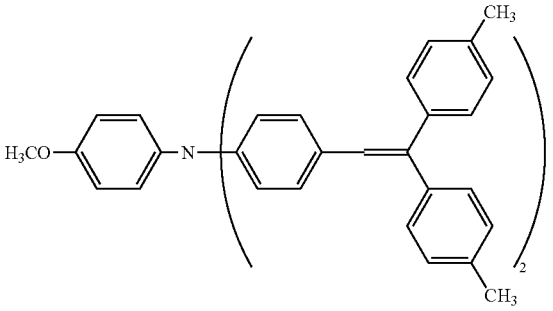
T34
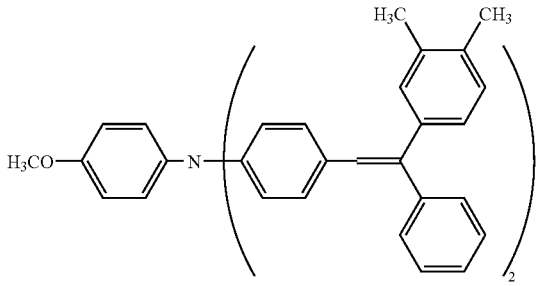
-continued
T35
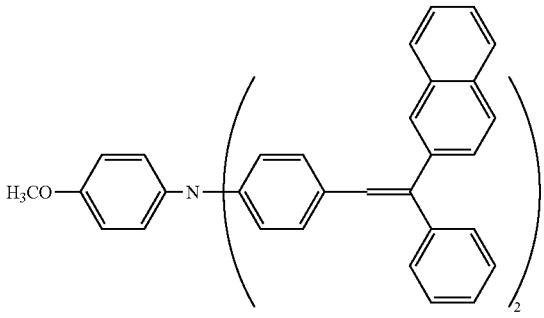
T36
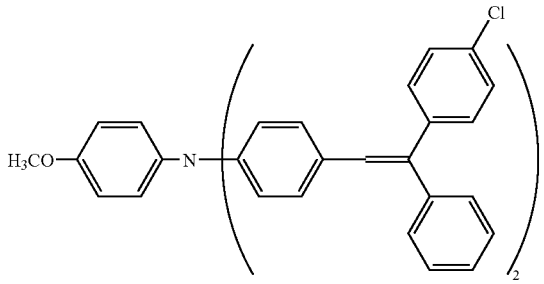
T37
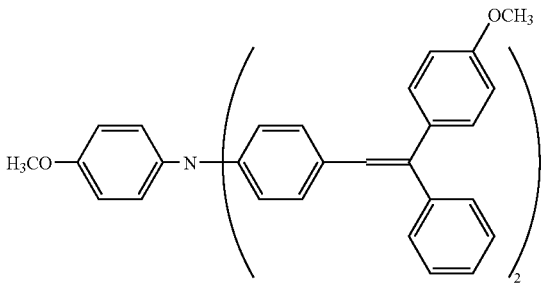
T38
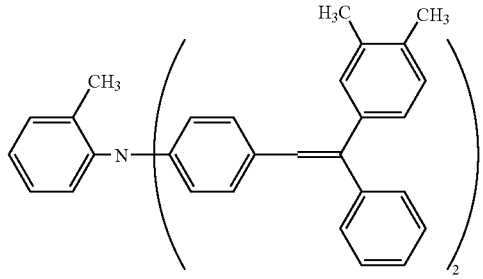
T39
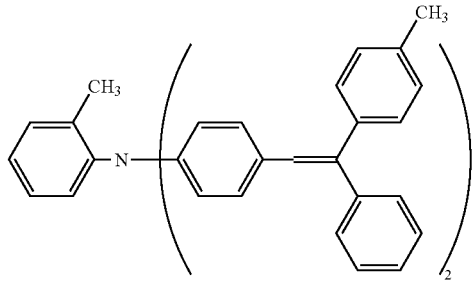

-continued
T40
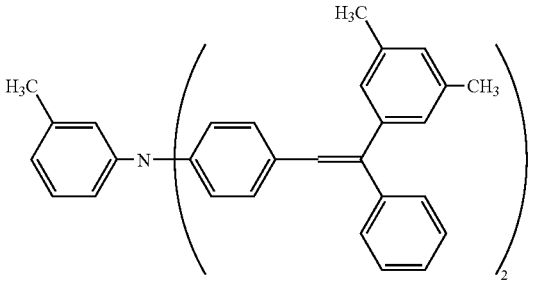
T41
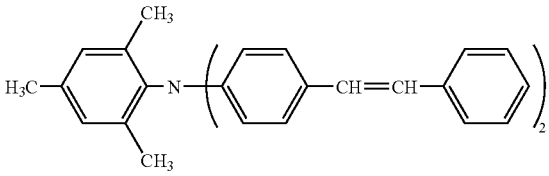
T42
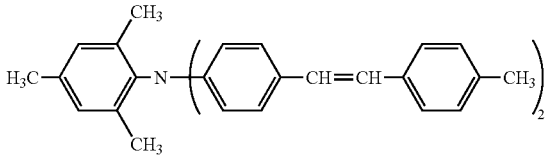
T43
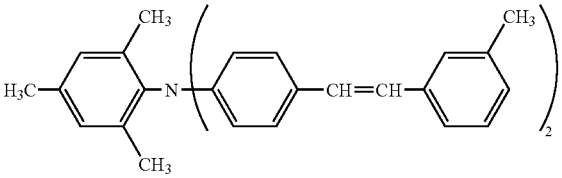
T44
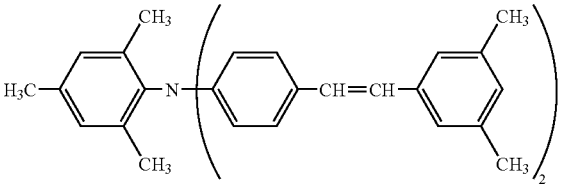
T45
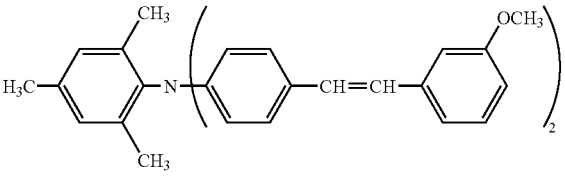
-continued
T46
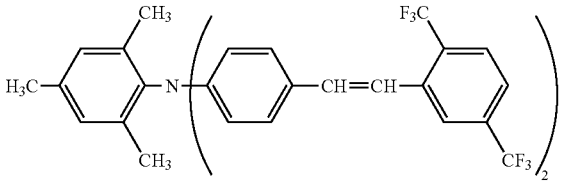
T47
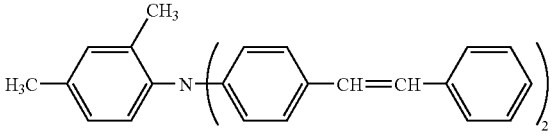
T48
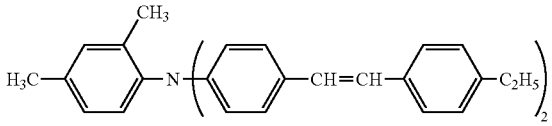
T49
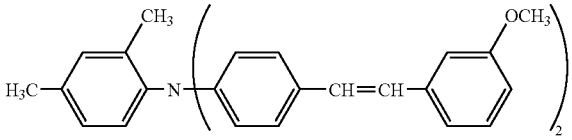
T50
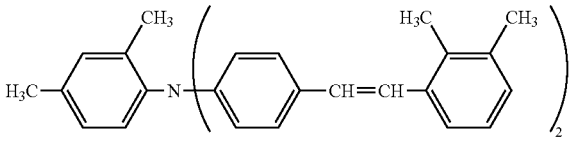
T51
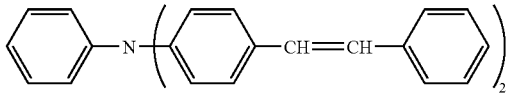
T52
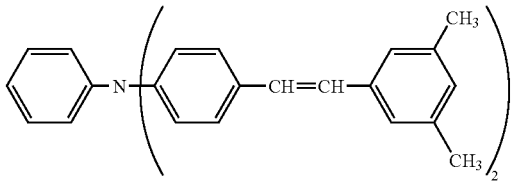
T53
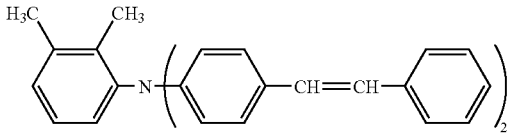

-continued
T54
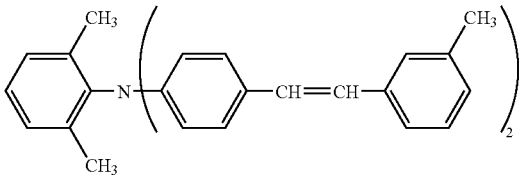
T55
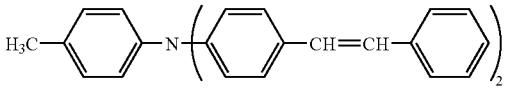
T56
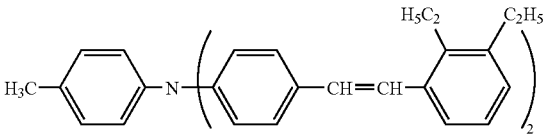
T57
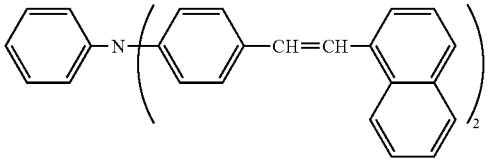
T58
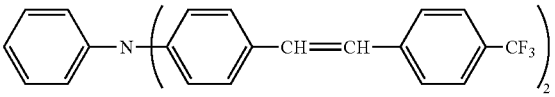
T59
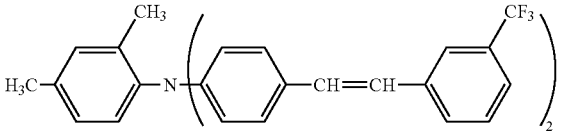
T60
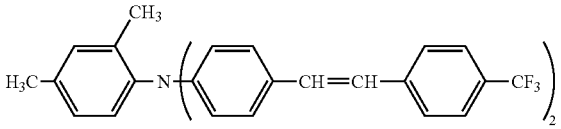
-continued
T61
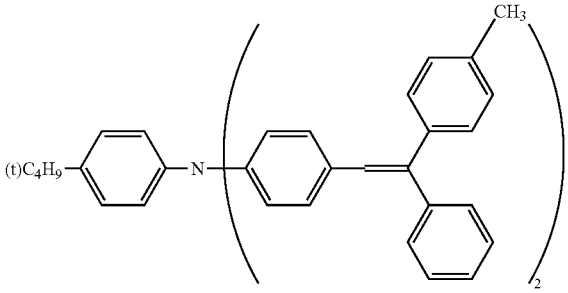
T62
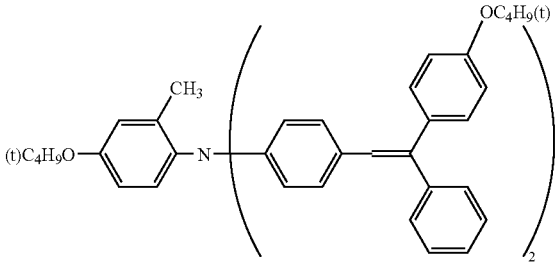
T63
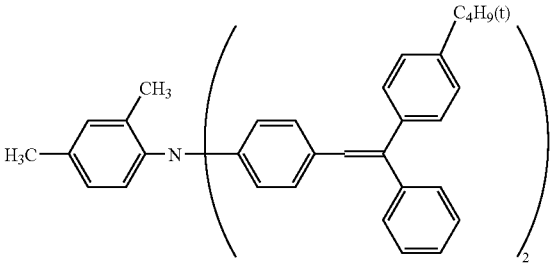
T64
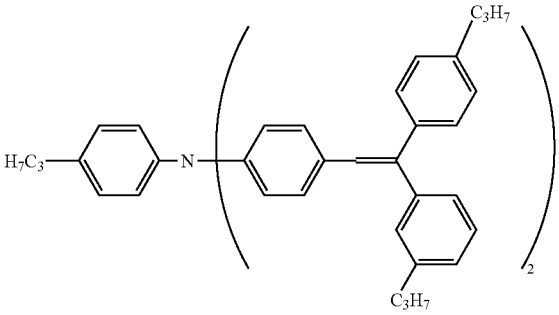
On the other hand, bis- or tributadiene based compounds, as described herein, refer to compounds which symmetrically have two or three butadiene structure via a nitrogen atom. The compounds represented by General Formulas (8) and (9) described below are preferred.

General Formula (8)

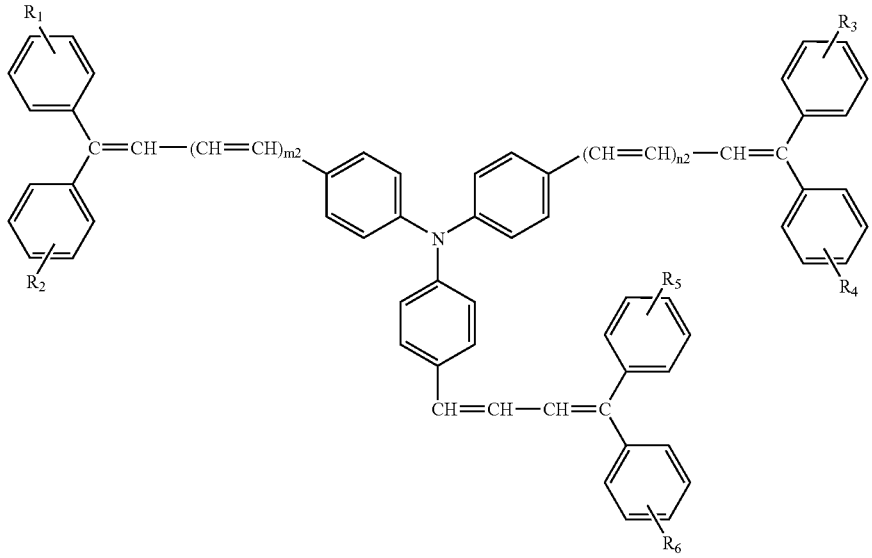

In General Formula (8), $R_1$, $R_2$, $R_3$, $R_4$, $R_5$, and $R_6$ may be the same or different. Each represents a hydrogen atom, an alkyl group, an aryloxy group, a halogen atom, or an aryl group which may have a substituent, and m2 and n2 each represents 0 or 1.

General Formula (9)

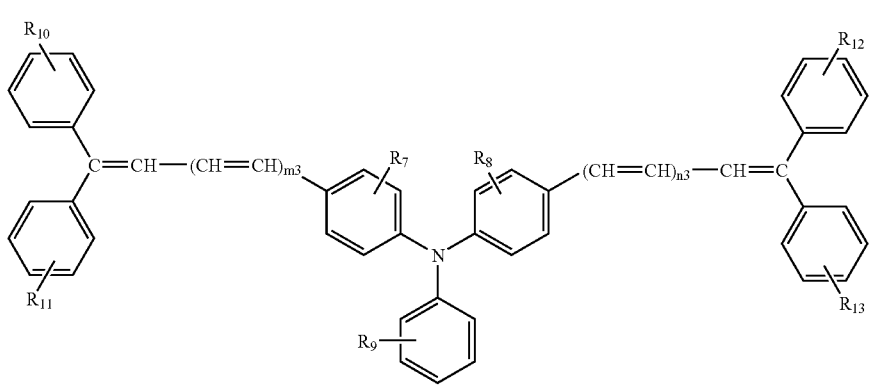

In General Formula (9), $R_7$ through $R_{13}$ may be the same or different, and each represents a hydrogen atom, a lower alkyl group, an alkoxy group, an aryloxy group, a halogen atom, or an aryl group which may be substituted, and m3 and n3 each represents 0 or 1.

Examples of charge ttansport materials comprised of bis- or tributadiene based compounds having a stereoisomeric structure are listed below.

T71

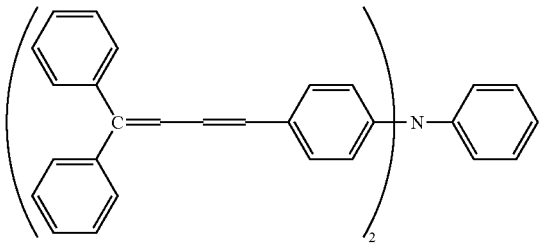

-continued
T72
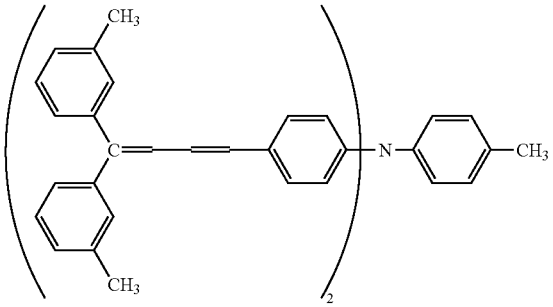
T73
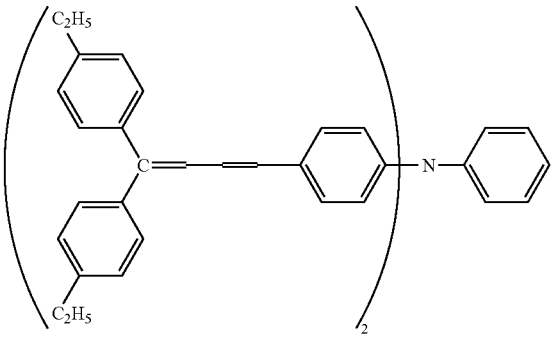
T74
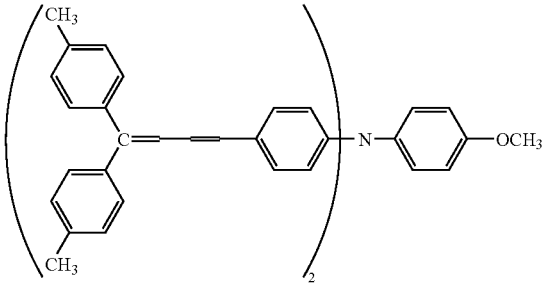
T75
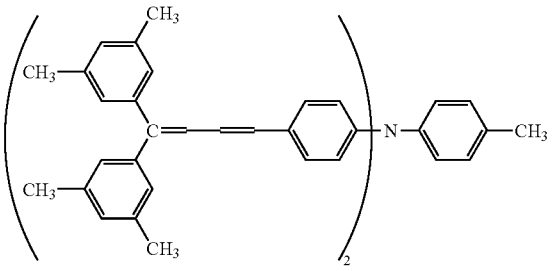
-continued
T76
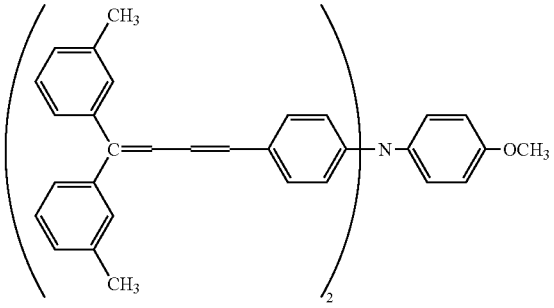
T77
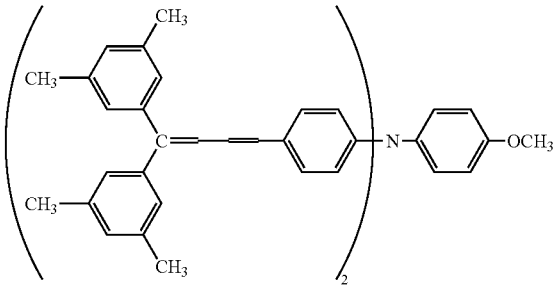
T78
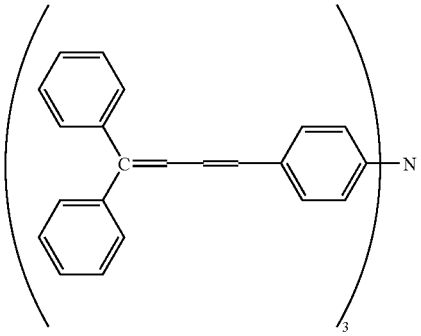
T79
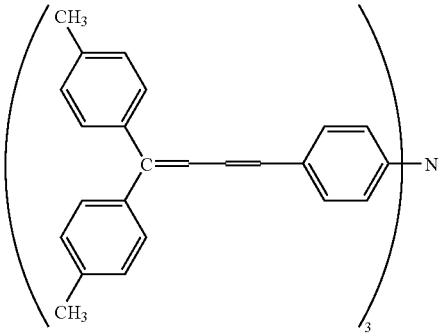

T80
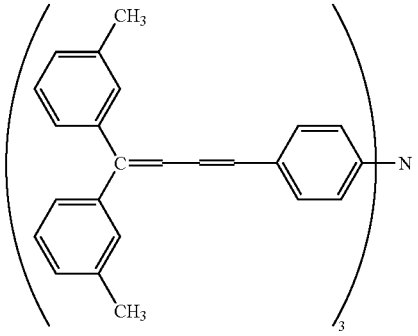
T81
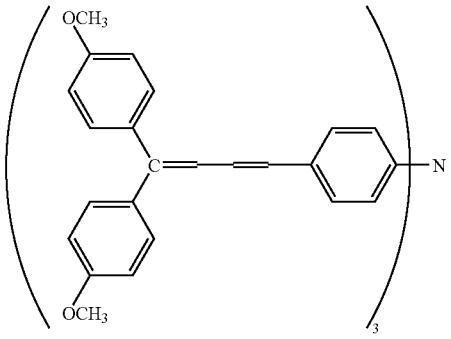
T82
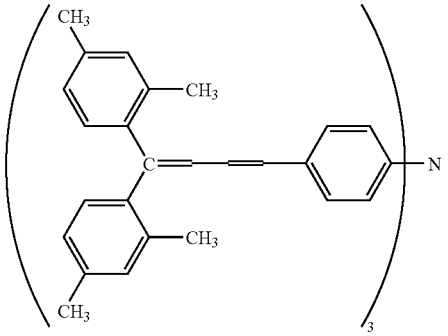
T83
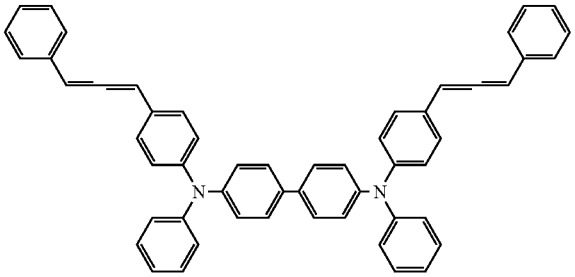
T84
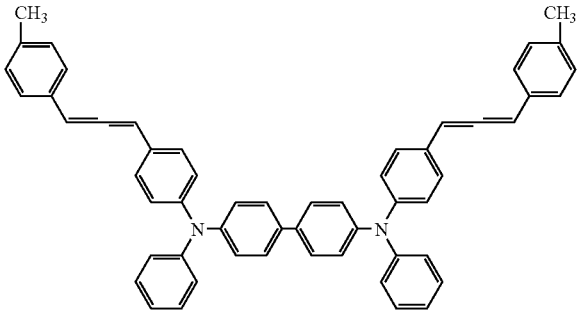
T85
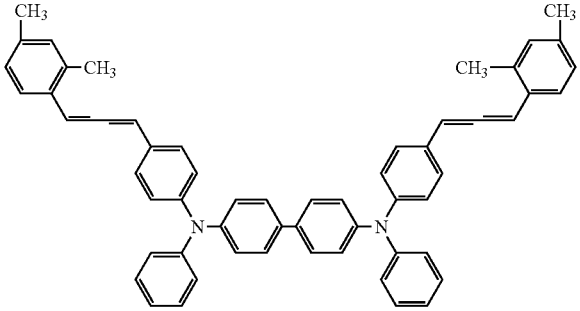
T86
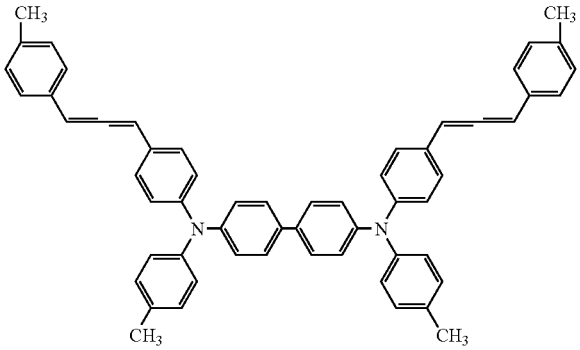
T87
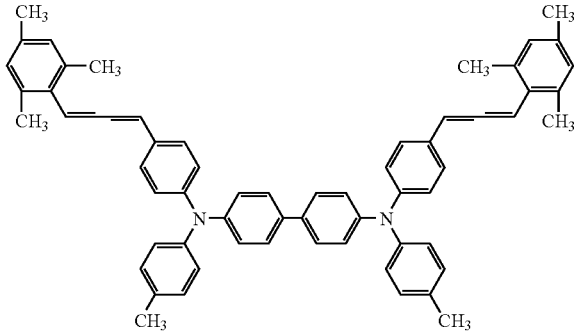

-continued
T88
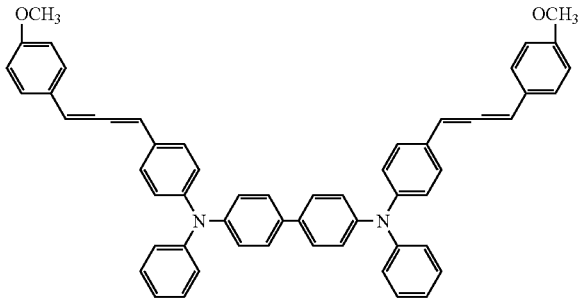
T89
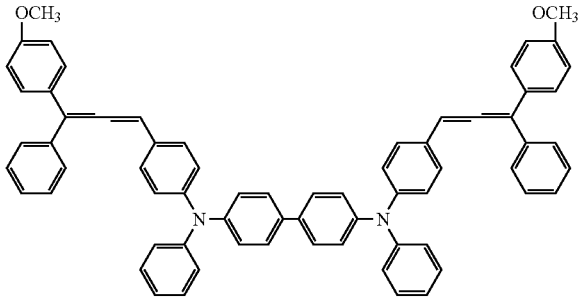
T90
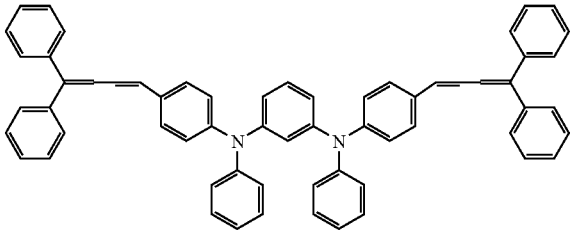
T91
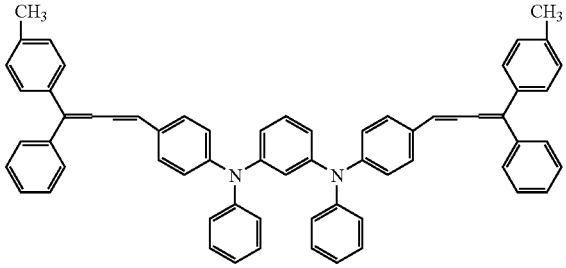
T92
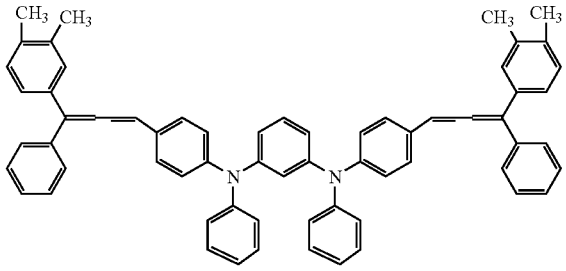
-continued
T93
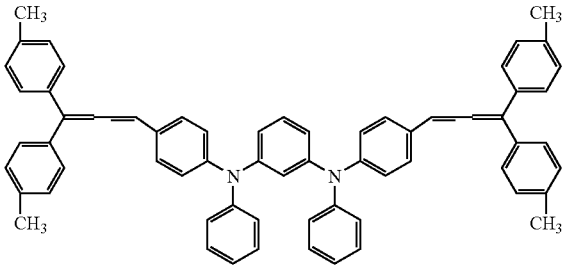
T94
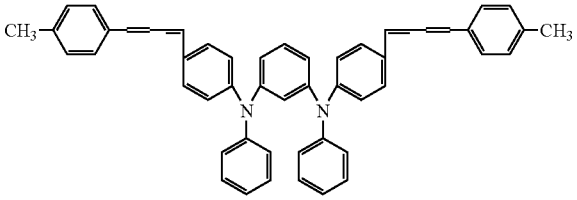
T95
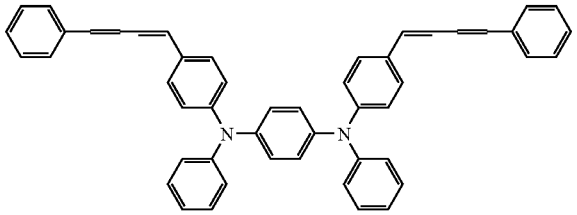
T96
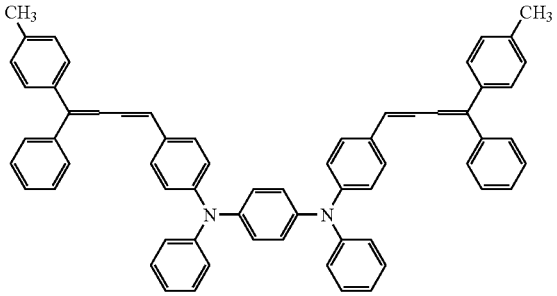
T97
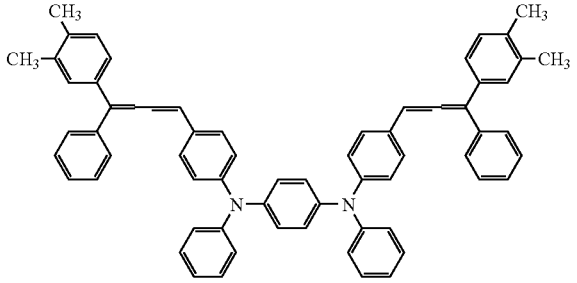
Layer arrangement of the organic photoreceptor employing the CTM mentioned above.
The organic photoreceptor employed in the invention comprises an organic compound having at least one of the charge generation or charge transport function. The photoreceptor contains an organic charge generation material or a charge transport material, or a polymer complex having charge generation and charge transport functions.

The component of the electrographic photoreceptor according to the invention is described below.

Electroconductive Support

A cylindrical electroconductive support is preferably used to make compact the image forming apparatus even though a cylindrical and sheet-shaped support may either be used.

Images can be endlessly formed by the cylindrical electroconductive support. The electroconductive support having a straightness of not more than 0.1 mm and a swing width of not more than 0.1 mm is preferred.

A drum of metal such as aluminum or nickel, a plastic drum on the surface of which aluminum, tin oxide or indium oxide is provided by evaporation, and a plastic and paper drum each coated with an electroconductive substance may be used as the material. The specific electric resistively of the electroconductive support is preferably not more than $10^3$ Ωcm.

The electric conductive support having sealing processed alumite coating at the surface may be employed in the invention. The alumite processing is conducted in acidic bath such as chromic acid, oxalic acid, phosphoric acid, boric acid sulfamic acid etc., and anodic oxidation process in sulfuric acid provides most preferable result. Preferred condition for the anodic oxidation process in sulfuric acid is, for example, sulfuric acid content of 100 to 200 g/l, aluminum ion content of 1 to 10 g/l, bath temperature of around 20° C., and applying voltage of around 20 V. Thickness of the anodic oxidation coating is usually 20 μm or less, particularly 10 μm or less is preferable in average.

Interlayer

In the present invention, an interlayer, functioning as a barrier, may be provided between the electrically conductive support and the photosensitive layer.

In the present invention, an interlayer may be provided between the electrically conductive support and the photosensitive layer for the purpose of improving adhesiveness between the conductive support and the photosensitive layer, or inhibiting the charge penetration from the support.

Listed as an interlayer are materials for the interlayer such as polyamide resin, vinyl chloride resin, vinyl acetate and copolymer resin having two or more repeating unit of these. Polyamide resin, which can minimize the residual potential after repeating use, is preferable. The thickness of the interlayer is preferably between 0.01 and 0.5 μm.

An example of the inter layer employed in the present invention is an inter layer which has hardened metal resin which is obtained by hardening an organic metal compound such as silane coupling agent, titanium coupling agent and so on. The thickness of the inter layer having hardened resin is preferably 0.1 to 2 μm.

An intermediate layer containing the N type semi-conductive fine particles dispersed in a binder resin is preferably employed. Average particle diameter is preferably 0.01 to 1 μm. Particularly an inter layer having surface-treated N type semi-conductive fine particles dispersed in a binder resin is preferable. The example is an inter layer in which titanium oxide having particle diameter of 0.01 to 1 μm surface-treated by silica, alumina or silane compound is dispersed in a binder resin. Thickness if the inter layer is preferably 1 to 20 μm.

The N type semi-conductive fine particles used in the invention refer to fine particles having a property in which conductive carrier is an electron. The property in which conductive carrier is an electron is a property that the N type semi-conductive fine particles, when contained in an insulating binder, efficiently block incorporation of holes from a support, and do not block incorporation of electrons from a photoreceptive layer.

The N type semi-conductive fine particles are described.

An inter layer having thickness of 5 mm is formed, by coating a composition containing particles of 50 weight percent dispersed in a binder resin is prepared. The layer is negatively charged and light decay property is evaluated, and further positively charged and light decay property is evaluated.

The fine particles having larger negative charge light decay than positive decay is N type semi-conductive fine particles.

Examples of the N type semi-conductive fine particles include fine particles of titanium oxide (TiO2), zinc oxide (ZnO2), and tin oxide (SnO2). In the invention, titanium oxide is preferably used.

With respect to the average particle size of the N type semi-conductive fine particles used in the invention, the N type semi-conductive fine particles have a number average primary order particle size of preferably 10 to 500 nm, more preferably 10 to 200 nm, and most preferably 15 to 50 nm.

A coating composition for forming an intermediate layer, containing the N type semi-conductive fine particles having such a number average primary order particle size as described above, has good dispersion stability. Further, the intermediate layer formed from such a coating composition provides a sufficient potential stability and restrains black spot occurrence.

The number average primary order particle size of the N type semi-conductive fine particles described above is obtained by the following. For example, the titanium oxide particles are magnified by a factor of 10,000 according to a transmission electron microscope, and one hundred particles are randomly selected as primary order particles from the magnified particles, and are obtained by measuring an average value of the Fere diameter according to image analysis.

As the N type semi-conductive fine particles used in the invention there are N type semi-conductive fine particles in the dendritic, acicular or granular form. With respect to a crystal structure of such N type semi-conductive fine particles, for example, crystal structures of the titanium oxide include a crystal structure of anatase type, rutile type or amorphous type. Any type crystal structure or a mixture of two or more kinds of crystal structures can be used in the invention. The rutile type is most preferred.

In the invention, one of the surface treatments of the N type semi-conductive fine particles is that the N type semi-conductive fine particles are subjected to plural surface treatments and the final surface treatment is carried out employing a reactive organic silicon compound. It is preferred that at least one of the plural surface treatments is carried out employing at least one of alumina, silica and zirconia, and the final surface treatment is carried out employing a reactive organic silicon compound. The surface treatment with alumina, silica or zirconia described later refers to surface treatment precipitating alumina, silica or zirconia on the surface of the N type semi-conductive fine particles. The alumina, silica and zirconia precipitated on the surface also include their hydrates. The surface treatment with a reactive organic silicon compound refers to treatment employing the reactive organic silicon compound in a solution for surface treatment.

In the invention, another of the surface treatments of the N type semi-conductive fine particles is that the N type semi-conductive fine particles are subjected to plural surface treatments and the final surface treatment is carried out employing a reactive organic titanium compound or a reactive organic zirconium compound. It is preferred that at least one of the plural surface treatments is carried out employing at least one of alumina, silica and zirconia, and the final surface treatment is carried out employing a reactive organic titanium compound or a reactive organic zirconium compound.

Coverage of the surface of the N type semi-conductive fine particles such as the titanium oxide particles subjected to at least two surface treatments is uniform, and an intermediate layer containing the resulting N type semi-conductive fine particles can provide an intermediate layer with good dispersion stability, and a photoreceptor which does not produce image defects such as black spots.

Photosensitive Layer

It is preferable that the photosensitive layer having a charge generation layer CGL and a charge transport layer CTL separated from each other even though a single structure photosensitive layer having both of the charge generation function and the charge transport function may be used. The increasing of the remaining potential accompanied with repetition of the use can be inhibited and another electrophotographic property can be suitably controlled by the separation the functions of the photosensitive layer into the charge generation and the charge transport. In the photoreceptor to be negatively charged, it is preferable that the CGL is provided on a subbing layer and the CTL is further provided on the CGL. In the photoreceptor to be positively charged, the order of the CGL and CTL in the negatively charged photoreceptor is revered. The foregoing photoreceptor to be negatively charged having the function separated structure is most preferable.

The photosensitive layer of the function separated negatively charged photoreceptor is described below.

Charge Generation Layer

Charge generation layer: the charge generation layer contains one or more kinds of charge generation material CGM. Another material such as a binder resin and additive may be contains according to necessity.

Examples of usable CGM include a phthalocyanine pigment, an azo pigment, a perylene pigment and an azulenium pigment. Among them, the CGM having a steric and potential structure capable of taking a stable intermolecular aggregated structure can strongly inhibit the increasing of the remaining potential accompanied with the repetition of use. Concrete examples of such the CGM include a phthalocyanine pigment and a perylene pigment each having a specific crystal structure. For example, a titanyl phthalocyanine having the maximum peak of Bragg angle 2θ of Cu-Kα ray at 27.2° and a benzimidazoleperylene having the maximum peak of Bragg angle 2θ of Cu-Kα ray at 12.4° as the CGM are almost not deteriorated by the repetition of use and the increasing of the remaining potential is small.

A binder can be used in the charge generation layer as the dispersion medium of the CGM. Examples of the most preferable resin include a formal resin, a silicone resin, a silicon-modified butyral resin and a phenoxy resin. The ratio of the binder resin to the charge generation material is from 20 to 600 parts by weight to 100 parts by weight of the binder resin. By the use of such the resin, the increasing of the remaining potential accompanied with the repetition of use can be minimized. The thickness of the charge generation layer is preferably from 0.01 μm to 2 μm.

Charge Transport Layer

Charge transport layer: the charge transport layer is a layer which has a function to transfer charge carrier (an electron or a hole) generated by charge generation material.

The surface layer according to the invention has a charge transport function, and contains a charge transport material CTM of steric isomers mixture and a layer-formable binder resin in which the CTM is dispersed. An additive such as an antioxidant may be further contained according to necessity.

The other charge transport material can be employed in addition to the mixture of the steric isomers mentioned above in combination. For example, a triphenylamine derivative, a hydrazone compound, a styryl compound, a benzyl compound and a butadiene compound may be used as the charge transport material CTM. These charge transport material are usually dissolved in a suitable binder resin to form a layer.

Examples of the resin to be used for charge transport layer CTL include a polystyrene, an acryl resin, a methacryl resin, a vinyl chloride resin, a vinyl acetate resin, a poly(vinyl butyral) resin, an epoxy resin, a polyurethane resin, a phenol resin, a polyester resin, an alkyd resin, a polycarbonate resin, a silicone resin, a melamine resin, a copolymer containing two or more kinds of the repeating unit contained the foregoing resins, and a high molecular weight organic semiconductive material such as poly(N-vinylcarbazole) other than the foregoing insulating resins.

The polycarbonate resin is most preferable as the binder for CTL. The polycarbonate resin is most preferable since the resin simultaneously improves the anti-abrasion ability, the dispersing ability of the CTM and the electrophotographic property of the photoreceptor. The ratio of the binder resin to the charge transport material is preferably from 10 to 200 parts by weight to 100 parts by weight of the binder resin, and the thickness of the charge transport layer is preferably from 10 to 40 μm.

The charge transport layer preferably contains an antioxidant. The antioxidant is a substance which inhibits or restrains function of oxygen under the condition of light, heat or charging against an autoxidation substance in or at the surface of an organic photoreceptor. The representative compounds are listed.

1-1

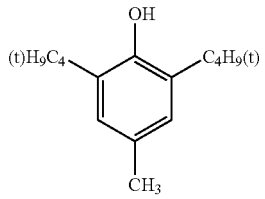

1-2

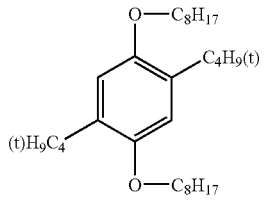

-continued
1-3
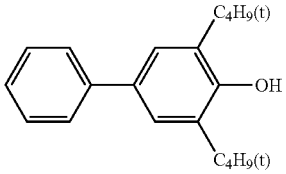
1-4
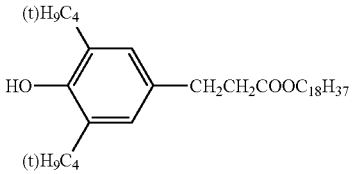
1-5
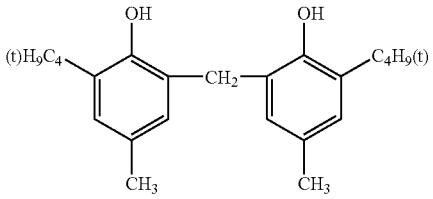
1-6
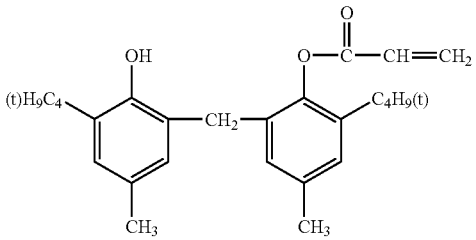
-continued
1-7
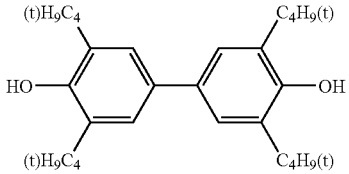
1-8
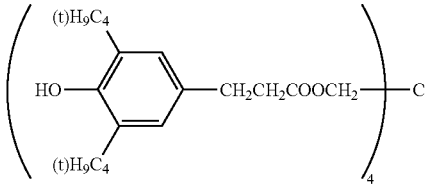
1-9
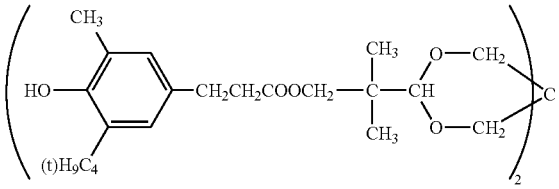
1-10
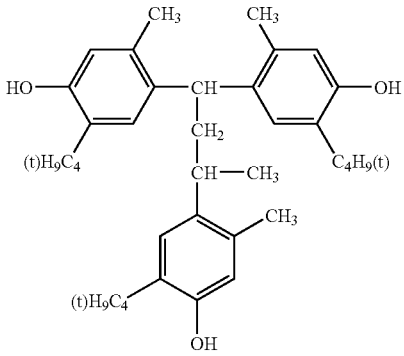
2-1
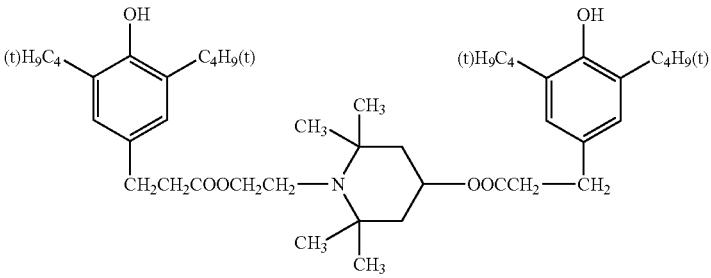

-continued 2-2

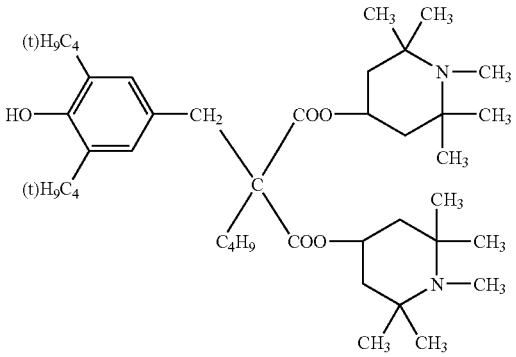

2-3

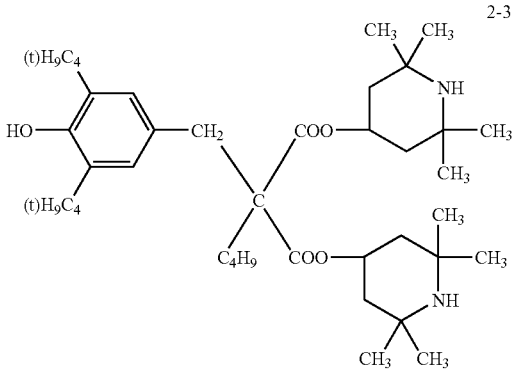

2-4

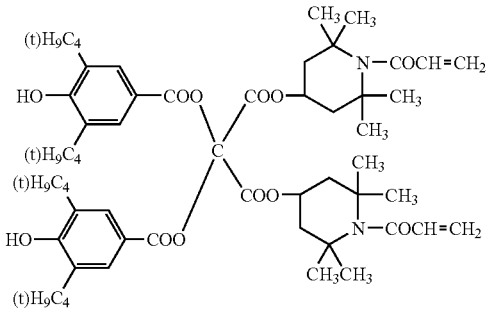

2-5

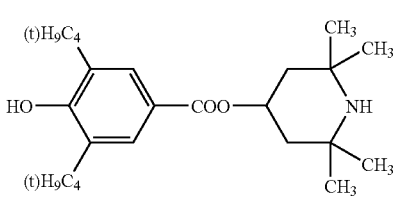

2-6

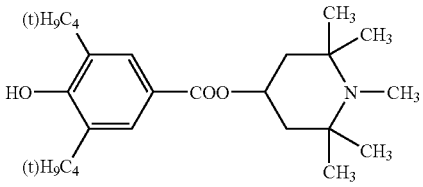

2-7

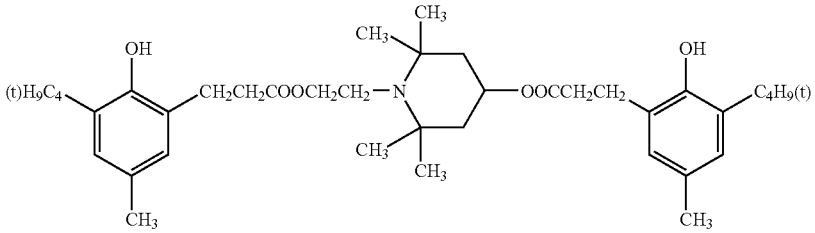

The charge transport layer is composed of two or more layers. The surface layer satisfies the condition according to the invention.

Listed as solvents or dispersion media employed for forming layers such as an inter layer, a photosensitive layer a protective layer of the photoreceptor are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like, however the present invention is not limited these. Of these, most preferably employed are dichloromethane, 1,2-dichloroethane or methyl ethyl ketone. Furthermore, these solvents may be employed individually or in combination of two types or more.

Next, employed as coating methods to produce the electrophotographic photoreceptor of the present invention may be a dip coating method, a spray coating method, a circular amount regulating type coating method, and the like. However, in order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the above-mentioned spray coating is, for example, described in JP O.P.I.Nos. 3-90250 and 3-269238, while the above-mentioned circular amount control type coating is detailed in, for example, JP O.P.I.No. 58-189061.

Described next will be the toner which is employed in the present invention. The toner employed in the invention preferably satisfies the following condition.

(1) The variation coefficient of said shape coefficient is not more than 16 percent.

(2) A number ratio of toner particles having a shape coefficient of 1.2 to 1.6 and is at least 65 percent.

(3) A number ratio of toner particles having no corners is 50 percent or more.

(4) A number variation coefficient in the toner number size distribution is not more than 27 percent.

(5) In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class. D is diameter of toner particles (in μm).

When the toner satisfying at least one of the above mentioned conditions (1) through (5) is employed in combination with a photoreceptor having surface characteristics according to the invention, generation of image deficiency such as white spots or black spots in the reverse development are inhibited, cleaning characteristics are improved, and therefore, good image is obtained. The conditions (2) and (5) are more important for displaying the advantages of the invention in comparison with the other conditions (1), (3) and (4). However, such conditions as (1), (3) and (4) are the characteristics to display the advantage of the invention. Particularly the combination of the toner satisfying all of the conditions (1) through (5) and the photoreceptor having specific surface layer, that is, a photoreceptor having charge transport layer containing CTM of a steric isomer mixture as the surface layer improves markedly the incompatible image deficiencies of white spots and black spots.

The condition (1) through (5) to the toner is detailed.

Shape coefficient of toner is a shape coefficient of toner particles, showing roundness of toner particles, which is defined as follows.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In the present invention, said shape coefficient was determined in such a manner that toner particles were photographed under a magnification factor of 2,000, employing a scanning type electron microscope, and the resultant photographs were analyzed employing "Scanning Image Analyzer", manufactured by JEOL Ltd. At that time, 100 toner particles were employed and the shape coefficient of the present invention was obtained employing the aforementioned calculation formula.

The polymerized toner of the present invention is that the number ratio of toner particles in the range of said shape coefficient of 1.2 to 1.6 is preferably at least 65 percent and is more preferably at least 70 percent.

By employing a toner having the number ratio of toner particles having a shape coefficient of 1.2 to 1.6 to at least 65 percent in combination with a photoreceptor having surface layer containing CTM of steric isomer mixture as above mentioned, generation of image deficiency such as white spots or black spots in the reverse development are inhibited, cleaning characteristics are improved, and therefore, good image with good sharpness is obtained.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.2 to 1.6, is blended with a common toner.

The polymerization toner is preferable in view of simple preparation and excellent uniformity of surface of he toner particles in comparison with the crushed toner. The polymerization toner is prepared by formation binder resin for toner particles, polymerization monomer material of binder resin having toner shape, and a chemical process if necessary. More in concrete the toner is prepared by polymerization reaction such as suspension polymerization or emulsion polymerization and fusing process of particles each other thereafter, if necessary.

Toner particles having uniform particle distribution and shape are obtained by polymerization toner because the toner is prepared by polymerization after monomer material is dispersed in an aqueous medium uniformly.

The variation coefficient of the polymerized toner is calculated using the formula described below:

$$\text{Variation coefficient}=(S/K)\times 100(\text{in percent})$$

wherein S represents the standard deviation of the shape coefficient of 100 toner particles and K represents the average of said shape coefficient.

Said variation coefficient of the shape coefficient is generally not more than 16 percent, and is preferably not more than 14 percent.

By employing the toner having variation coefficient of the shape coefficient to not more than 16 percent in combination with a photoreceptor having surface layer containing CTM of steric isomer mixture as above mentioned, generation of image deficiency such as white spots or black spots in the reverse development are inhibited, cleaning characteristics are improved, and therefore, good image with good sharpness is obtained.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles)

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by TOA MEDICAL ELECTRONICS CO., LTD.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 μm aperture. The volume and the number of particles having a diameter of at least 2 μm were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution of toner is calculated employing the formula described below:

$$\text{Number variation coefficient}=(S/D_n)\times 100(\text{in percent})$$

wherein S represents the standard deviation in the number particle size distribution and Dn represents the number average particle diameter (in μm).

The number variation coefficient of the toner of the present invention is not more than 27 percent, and is preferably not more than 25 percent.

By employing a toner having the number variation coefficient to not more than 27 percent in combination with a photoreceptor having surface layer containing CTM of steric isomer mixture as above mentioned, generation of image deficiency such as white spots or black spots in the reverse development are inhibited, cleaning characteristics are improved, and therefore, good image with good sharpness is obtained.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

A number ratio of toner particles having no corners is 50 percent or more, and preferably 70 percent of more.

By employing a toner having no corners is 50 percent or more in combination with a photoreceptor having surface layer containing CTM of steric isomer mixture as above mentioned, generation of image deficiency such as white spots or black spots in the reverse development are inhibited, cleaning characteristics are improved, and therefore, good image with good sharpness is obtained.

The toner particles of the present invention, which substantially have no corners, as described herein, mean those having no projection to which charges are concentrated or which tend to be worn down by stress. Namely, as shown in FIG. 1(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 1(*b*) and 1(*c*) show the projection images of a toner particle having corners.

Toner having no corners is measured as follows. First, an image of a magnified toner particle is made employing a scanning type electron microscope. The resultant picture of the toner particle is further magnified to obtain a photographic image at a magnification factor of 15,000. Subsequently, employing the resultant photographic image, the presence and absence of said corners is determined. Said measurement is carried out for 100 toner particles.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

The diameter of the toner particles of the present invention is preferably between 3.0 and 8.5 μm in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3.0 to 8.5 μm, improved is the halftone image quality as well as general image quality of fine lines, dots, and the like.

The polymerized toner, which is preferably employed in the present invention, is as follows. The diameter of toner particles is designated as D (in μm). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

Measurement Conditions (1) Aperture: 100 μm (2) Method for preparing samples: an appropriate amount of a surface active agent (a neutral detergent) is added while stirring in 50 to 100 ml of an electrolyte, Isoton R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

It is possible to prepare the toner of the present invention in such a manner that fine polymerized particles are produced employing a suspension polymerizing method, and emulsion polymerization of monomers in a liquid added with an emulsion of necessary additives is carried out, and thereafter, association is carried out by adding organic solvents, coagulants, and the like. Methods are listed in which during association, preparation is carried out by associating upon mixing dispersions of releasing agents, colorants, and the like which are required for constituting a toner, a method in which emulsion polymerization is carried out upon dispersing toner constituting components such as releasing agents, colorants, and the like in monomers, and the like. Association as described herein means that a plurality of resinous particles and colorant particles are fused.

The polymerization toner is prepared by formation binder resin for toner particles, polymerization monomer material of binder resin having toner shape, and a chemical process if necessary. More in concrete the toner is prepared by polymerization reaction such as suspension polymerization or emulsion polymerization and fusing process of particles each other thereafter, if necessary.

Added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating. After completing the reaction, the dispersion stabilizers are removed, filtered, washed, and subsequently dried. In this manner, the toner of the present invention is prepared.

The water based medium as described in the present invention means one in which at least 50 percent, by weight of water, is incorporated.

Further, listed as a method for preparing said toner may be one in which resinous particles are associated, or fused, in a water based medium. Said method is not particularly limited but it is possible to list, for example, methods described in Japanese Patent Publication Open to Public Inspection Nos. 5-265252, 6-329947, and 9-15904. Namely, it is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed alone or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane)propane, tris-(t-butylperoxy)triazine, and the like; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 1,000,000, which can be measured employing gel permeation chromatography. Further preferred as resins are those having a molecular weight distribution of Mw/Mn of 1.5 to 100, and is most preferably between 1.8 and 70.

Employed coagulants are not particularly limited, but those selected from metal salts are more suitable.

Specifically, listed as univalent metal salts are salts of alkaline metals such as, for example, sodium, potassium, lithium, and the like; listed as bivalent metal salts are salts of alkali earth metals such as, for example, calcium, magnesium, and salts of manganese, copper, and the like; and listed as trivalent metal salts are salts of iron, aluminum, and the like. Listed as specific salts may be sodium chloride, potassium chloride, lithium chloride, calcium chloride, zinc chloride, copper sulfate, magnesium sulfate, manganese sulfate, and the like. These may also be employed in combination.

These coagulants are preferably added in an amount higher than the critical coagulation concentration. The critical coagulation concentration as described herein means an index regarding the stability of water based dispersion and concentration at which coagulation occurs through the addition of coagulants. Said critical coagulation concentration markedly varies depending on emulsified components as well as the dispersing agents themselves. Said critical coagulation concentration is described in, for example, Seizo Okamura, et al., "Kobunshi Kagaku (Polymer Chemistry) 17", 601 (1960) edited by Kobunshi Gakkai, and others. based on said publication, it is possible to obtain detailed critical coagulation concentration. Further, as another method, a specified salt is added to a targeted particle dispersion while varying the concentration of said salt; the ξ potential of the resultant dispersion is measured, and the critical coagulation concentration is also obtained as the concentration at which said ξ potential varies.

The acceptable amount of the coagulating agents of the present invention is an amount of more than the critical coagulation concentration. However, said added amount is preferably at least 1.2 times as much as the critical coagulation concentration, and is more preferably 1.5 times.

The solvents, which are infinitely soluble as described herein, mean those which are infinitely soluble in water, and in the present invention, such solvents are selected which do not dissolve the formed resins. Specifically, listed may be alcohols such as methanol, ethanol, propanol, isopropanol, t-butanol, methoxyethanol, butoxyethanol, and the like.

Ethanol, propanol, and isopropanol are particularly preferred.

The added amount of infinitely soluble solvents is preferably between 1 and 100 percent by volume with respect to the polymer containing dispersion to which coagulants are added.

Incidentally, in order to make the shape of particles uniform, it is preferable that colored particles are prepared, and after filtration, the resultant slurry, containing water in an amount of 10 percent by weight with respect to said particles, is subjected to fluid drying. At that time, those having a polar group in the polymer are particularly preferable. For this reason, it is assumed that since existing water somewhat exhibits swelling effects, the uniform shape particularly tends to be made.

The toner of the present invention is comprised of at least resins and colorants. However, if desired, said toner may be comprised of releasing agents, which are fixability improving agents, charge control agents, and the like. Further, said toner may be one to which external additives, comprised of fine inorganic particles, fine organic particles, and the like, are added.

Optionally employed as colorants, which are used in the present invention, are carbon black, magnetic materials, dyes, pigments, and the like. Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, the same 60, and the like, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants of which surface has been subjected to treatment employing coupling agents, and the like, so that radical polymerization is not hindered.

Further, added as fixability improving agents may be low molecular weight polypropylene (having a number average molecular weight of 1,500 to 9,000), low molecular weight polyethylene, and the like.

Employed as charge control agents may also be various types of those which can be dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof.

Incidentally, it is preferable that the number average primary particle diameter of particles of said charge control agents as well as said fixability improving agents is adjusted to about 10 to about 500 nm in the dispersed state.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of said medium in the reaction vessel. Namely, when toner particles, which have a shape coefficient of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape coefficient of not more than 1.2, are formed, employed as the flow of the medium in the reaction vessel is a laminar flow. Spherical particles are obtained by minimizing collisions among said particles. By employing said methods, it is possible to control the distribution of shaped toner particles within the range of the present invention.

A reaction apparatus equipped with stirring planes which can be desirably used in a suspension polymerization method will be explained by using the drawings.

Figure 3:
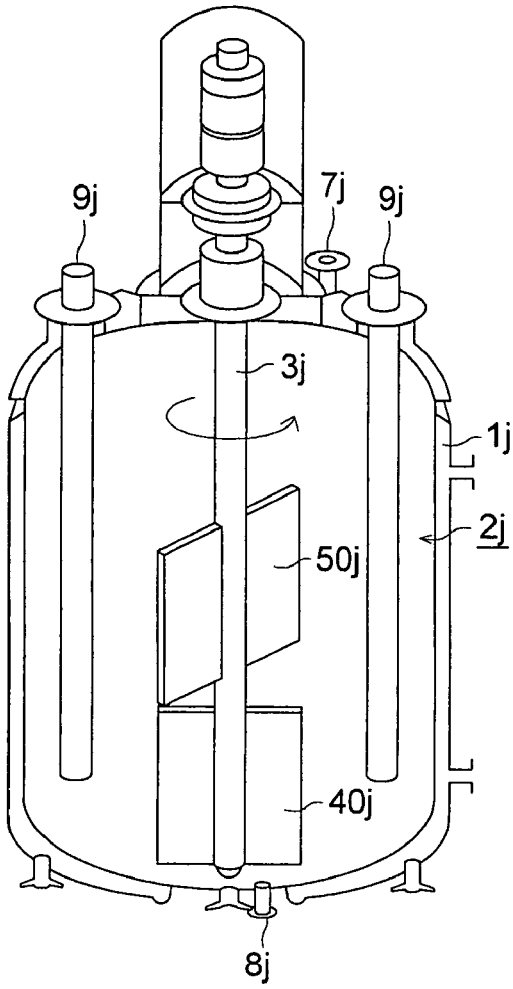
FIG. 3 is a perspective view showing one example of a polymerization toner reaction apparatus.
Figure 4:
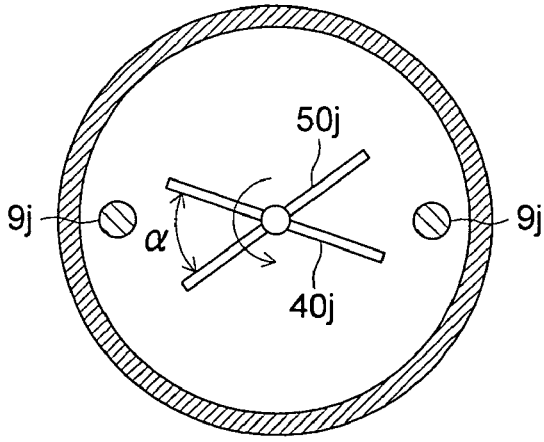
FIG. 4 is a cross-sectional view showing one example of a polymerization toner reaction apparatus.

FIG. 3 and FIG. 4 are a perspective view and a cross-sectional view respectively both showing an example of such a reaction apparatus. In the reaction apparatus shown in FIG. 3 and FIG. 4, a rotary shaft 3*j* is mounted vertically at the central part of a vertical cylindrical stirring tank 2*j* with a jacket 1*j* for heat exchange mounted on the outer circumference portion of the stirring tank, and a stirring plane 40*j* mounted to the rotary shaft 3*j* close to the bottom surface of the stirring tank 2 and a stirring plane 50*j* mounted to the shaft at an upper position of this stirring plane 40*j* are provided. The upper stirring plane 50*j* is arranged in such a way as to make a crossing angle $\alpha$ preceding in the rotating direction with the stirring plane positioned at the lower stage. In the case where a toner of this invention is produced, it is desirable to make the crossing angle $\alpha$ smaller than 90°. Although there is no lower limitation for this crossing angle $\alpha$, it is desirable that it is not smaller than about 5°, and more desirably, it should be not smaller than 10°. In addition, in the case where stirring planes having a three-stage structure are provided, it is desirable that the crossing angle between any stirring plane and its neighboring stirring plane is smaller than 90°.

By employing the configuration as described above, it is assumed that, firstly, a medium is stirred employing stirring blades 50*j* provided at the upper level, and a downward flow is formed. It is also assumed that subsequently, the downward flow formed by upper level stirring blades 50*j* is accelerated by stirring blades 40*j* installed at a lower level, and another flow is simultaneously formed by said stirring blades 50*j* themselves, as a whole, accelerating the flow. As a result, it is further assumed that since a flow area is formed which has large shearing stress in the turbulent flow, it is possible to control the shape of the resultant toner.

Arrows show the rotation direction, reference numeral 7*j* is upper material charging inlet, 8*j* is a lower material charging inlet, and 9*j* is a turbulent flow. forming member which makes stirring more effective, in FIGS. 3 and 4.

Herein, the shape of the stirring blades is not particularly limited, but employed may be those which are in square plate shape, blades in which a part of them is cut off, blades having at least one opening in the central area, having a so-called slit, and the like. FIGS. 5(*a*) through 5(*d*) describe specific examples of the shape of said blades. Stirring blade 5*a* shown in FIG. 5(*a*) has no central opening; stirring blade 5*b* shown in FIG. 5(*b*) has large central opening areas 6*b*; stirring blade 5*c* shown in FIG. 4(*c*) has rectangular openings 6*c* (slits); and stirring blade 5*d* shown in FIG. 5(*d*) has oblong openings 6*d* shown in FIG. 5(*d*). Further, when stirring blades of a three-level configuration are installed, openings which are formed at the upper level stirring blade and the openings which are installed in the lower level may be different or the same.

Still further, the space between the upper and the lower stirring blades is not particularly limited, but it is preferable that such a space is provided between stirring blades. The specific reason is not clearly understood. It is assumed that a flow of the medium is formed through said space, and the stirring efficiency is improved. However, the space is generally in the range of 0.5 to 50 percent with respect to the height of the liquid surface in a stationary state, and is preferably in the range of 1 to 30 percent.

Further, the size of the stirring blade is not particularly limited, but the sum height of all stirring blades is between 50 and 100 percent with respect to the liquid height in the stationary state, and is preferably between 60 and 95 percent.

On the other hand, in toner which is prepared employing the polymerization method in which resinous particles are associated or fused in a water based medium, it is possible to optionally vary the shape distribution of all the toner particles as well as the shape of the toner particles by controlling the flow of the medium and the temperature distribution during the fusion process in the reaction vessel, and by further controlling the heating temperature, the frequency of rotation of stirring as well as the time during the shape controlling process after fusion.

Namely, in a toner which is prepared employing the polymerization method in which resinous particles are associated or fused, it is possible to form toner which has the specified shape coefficient and uniform distribution by controlling the temperature, the frequency of rotation, and the time during the fusion process, as well as the shape controlling process, employing the stirring blade and the stirring tank which are capable of forming a laminar flow in the reaction vessel as well as forming making the uniform interior temperature distribution. The reason is understood to be as follows: when fusion is carried out in a field in which a laminar flow is formed, no strong stress is applied to particles under coagulation and fusion (associated or coagulated particles) and in the laminar flow in which flow rate is accelerated, the temperature distribution in the stirring tank is uniform. As a result, the shape distribution of fused particles becomes uniform. Thereafter, further fused particles gradually become spherical upon heating and stirring during the shape controlling process. Thus it is possible to optionally control the shape of toner particles.

Employed as the stirring blades and the stirring tank, which are employed during the production of toner employing the polymerization method in which resinous particles are associated or fused, can be the same stirring blades and stirring tank which are employed in said suspension polymerization in which the laminar flow is formed. Said apparatus is characterized in that obstacles such as a baffle plate and the like, which forms a turbulent flow, is not provided.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 5(*c*), which are formed of a continuous plane are preferable, and those having a curved plane may also be employed.

The toner of the present invention may be advantageously employed when combined with external additives of fine particles, such as fine inorganic particles and fine organic particles. As the reason for such combining, it is assumed that burying and releasing of external additives may be effectively minimized, and its effect is markedly exhibited.

Preferably employed as such fine inorganic particles are inorganic oxide particles such as silica, titania, alumina, and the like. These fine inorganic particles are preferably subjected to hydrophobic treatment employing silane coupling agents, titanium coupling agents, and the like. The degree of the hydrophobic treatment is not particularly limited, however the degree is preferably between 40 and 95 measured as methanol wettability. The methanol wettability as described herein means the evaluation of wettability for methanol.

In this method, 0.2 g of fine inorganic particles is weighed and added to 50 ml of distilled water placed in a 200 ml beaker. Methanol is slowly added dropwise while slowly stirring from a burette of which top is immersed in the solution until entire fine organic particles are wet. The degree of hydrophobicity is calculated from the formula given below:

$$\text{Degree of hydrophobicity}=a/(a+50)100$$

wherein a·(in ml) represents the amount of methanol required for making fine inorganic particles perfectly wet. The added amount of said external additives is between 0.1 and 5.0 percent by weight of the toner, and is preferably between 0.5 and 4.0 percent by weight. As external additives, various materials may be employed in combination.

Developer

Toner according to the invention may be used as a single component developer in which magnetic material is incorporated in toner particles, a double component developer by mixing with a carrier, or a non magnetic single component toner. A double component developer is prepared by mixing a toner with a carrier.

The image forming apparatus of the present invention will now be described.

FIG. 1 is a view showing the entire structure of the image forming apparatus (the digital copier) which can be suitably applied to an image forming method in which double sided images are formed by transferring a toner image formed on an organic photoreceptor onto recording paper and fixed.

In FIG. 1, the digital copier comprises image reading section A, image processing section B, image storing section C, and image forming section D. Aforesaid image reading section A corresponds to a reading means; aforesaid image processing section B corresponds to an image processing means; aforesaid image storing section C corresponds to a data storing means; and aforesaid image forming section corresponds to an image forming means.

In image reading section A, original document 121 is placed on an original document glass plate (hereinafter referred to as a platen glass) and is illuminated by halogen light source 123 installed on a carriage which moves on a guide rail (not shown). Movable mirror unit 126, provided with paired mirrors 124 and 125, moves on the aforesaid slide rail. While combined with mirror 127 provided on the aforesaid carriage, reflected light from original document 121 on platen glass 122, namely an optical image, is channeled to lens reading unit 128. Aforesaid lens reading unit 128 is comprised of focusing lens 129 and CCD line sensor 130. The optical image corresponding to the image on original document 121, which is subjected to reflection transmission employing aforesaid mirrors 124, 125, and 127 is focused and is subjected to image formation on the light receiving surface of CCD line sensor 130. Subsequently, optical images on the line are successively subjected to photoelectric conversion to result in electric signals.

When a copy button provided in operation section 28 is depressed, image information equivalent to one page of the original document is read by CCD line sensor 130 while utilizing the movement of halogen light source 123 driven by a motor (not shown) while coupled, the carriage on which mirror 127 is provided and movable mirror 126. Original document 121, placed on platen glass 122 sheet by sheet, is read as stated above and output is carried out as image data for each page.

Image signals of the original document image read by aforesaid image reading section A, namely image data, are subjected to various types of image processing such as density conversion, filter processing, variable magnification processing, and $\gamma$ correction. Thereafter, the image data are outputted to image forming section D via image storing section C. Image forming section D performs image formation on recording paper corresponding to image data inputted by a laser printer utilizing electrophotographic techniques.

Namely, in image forming section D, a laser beam generated by a semiconductor laser (not shown) is modulated based on image signals. The resulting laser beam is subjected to rotational scanning employing polygonal mirror 142 which is rotated by driving motor 141. The beam path is then deflected by reflection mirror 143 via $f\theta$ lens and projected onto the surface of photoreceptor drum 151, whereby an electrostatic latent image is formed on uniformly charged photoreceptor drum 151. From the viewpoint of environmental protection as well as non-pollution, aforesaid photoreceptor drum 151 is preferably comprised of an organic photoreceptor.

Further provided are charging unit 152 (performing a charging process) which uniformly charges aforesaid photoreceptor drum 151, development unit 153 (performing a development process), transfer electrode 157 (performing a transfer process), separation electrode 158 (performing a separation process), cleaning unit 159 (performing a cleaning process), and fixing unit 160 (performing a fixing process). An electrostatic latent image formed on photoreceptor drum 151 is developed by aforesaid development unit 153 to form a toner image, which is transferred onto recording paper and fixed, whereby the copy image of an original document is prepared.

Recording paper sheets are stored in cassettes 171 through 174 corresponding to various sizes and are fed from any one of cassettes 171 through 174, corresponding to notification for the desired sheet size. The resulting sheets are subsequently supplied to photoreceptor drum 151, utilizing recording paper transport mechanism 175 comprised of a plurality of transport rollers as well as a transport belt.

When one side of recording paper is copied, a toner image is successively transferred onto the other side of the recording paper which is successively fed from a cassette and fixed, followed by ejection onto recording paper ejection tray 176.

When both sides of recording paper are copied, a transported recording paper, in which a toner image has been transferred onto one side and fixed, is directed downward by switching claw 177 (a broken lined position in FIG. 1) and is guided to an auto duplex unit (hereinafter referred to as ADU). Second switching claw 180 (a broken lined position in FIG. 1) in the recording paper transport path renders the recording paper to pass in the right direction. Subsequently, reversing roller 181 is subjected to reverse rotation and at the same time, the second switching claw is switched to the solid line position in FIG. 1. As a result, the front and the back of the recording paper are reversed. The resulting recording paper is fed to photoreceptor drum 151 via a reverse transport path in the same manner as paper fed from cassettes 171 and 172. Image data on the back of the original document is read out from image storing section C and an image is successively formed on the back of the recording paper, whereby a double sided copy is prepared.

Further, in the digital copier shown in FIG. 1, automatic original document feeding unit 81, which automatically feeds reading original document 121 onto aforesaid platen glass 122, is installed in aforesaid image reading section A. Aforesaid automatic original document feeding unit 81 places reading original documents on original document set stand 82 so that a plurality of them are stacked. When a copy button is depressed, aforesaid automatic original document feeding unit 81 successively transports each page of aforesaid original documents and automatically feeds each to the specified position on platen glass 122 in the proper order, and at the same time, removes read original document 121 from platen glass 122 and ejects it onto original document ejection tray 94.

Still further, other than successively feeding out single-sided original document 121 on which an image is recorded on one side and reading it, as stated above, aforesaid automatic original document feeding unit 81 is constituted so as to be capable of performing the following operations. One double sided original document is removed and fed onto platen glass 122. When the image on one side is read, the aforesaid original document is transported in the reverse direction and the direction is switched in the reversing section comprised of a reversing guide and a reversing roller so as to turn the original document over. The resulting original document is then fed to the specified position of platen glass 122 so that the image information on the back of the original document can be read.

In order to perform the automatic feeding of original documents as described above, provided are paper feeding roller 83 which feeds out each of original documents on original document set stand 82, driving roller 84 and driven roller 92, belt 86 which is driven in a loop by aforesaid driving roller 84 and driven roller 92, reversal section comprising guide plate 89, reversing roller 90, and switching guide 88 driven by solenoid 8 (not shown), and original document ejection roller 87.

When using such an automatic original document feeding unit, it is possible to automatically feed original documents 121 successively to the specified reading position on platen glass 122, irrespective of whether it is a double sided original document or a single sided one, and output as image signals.

The image forming method, which forms double sided images on recording paper, employing an electronic RDH (recirculating document handler), as described in the present invention, is different from the method in which double sided images are formed employing conventional analogue copiers, and refers to a method, in which recording paper in which an image is formed on one side, is not required to be stored but double sided images are formed by continually forming an image on the other side of the recording paper. Namely, based on image information which has been converted to an electronic image, a first digital electrostatic latent image is formed on a photoreceptor. After converting aforesaid electrostatic latent image into a toner image, the resulting toner image is transferred onto one side of recording paper and fixed. Thereafter, without storing, the aforesaid recording paper is immediately transported to the transfer process as well as the fixing process for an image on its other side, and the toner image based on the second electronic image formed on the aforesaid organic photoreceptor is transferred and fixed, whereby double sided images are formed.

An example of the image forming method comprises the following steps of;

forming a first toner image on a photoreceptor;

transferring the first toner image on a first side of a sheet;

fixing the first toner image on the sheet with a thermal fixing device;

returning the sheet from the fixing device to the photoreceptor without stacking the sheet on an intermediate tray while forming a second toner image on the photoreceptor;

transferring the second toner image on a second side of the sheet; and fixing the second toner image on the sheet with the. fixing device.

Further, in the aforesaid image forming apparatus, a processing cartridge may be detachably mounted in which at least either a photoreceptor, a development unit, a charging unit, a transfer electrode, a separation electrode, or a cleaning unit is integrated.

The organic photoreceptor, image forming method, image forming apparatus, and processing cartridge of the present invention are generally applied to electrophotographic apparatuses such as electrophotographic copiers, laser printers, LED printers, and liquid crystal shutter type printers, and may be widely applied to apparatuses such as displays, recording, short-run printing, plate making and facsimiles to which electrophotographic techniques are applied.

The present invention will now be detailed with reference to examples. In the following description, "parts" are parts by weight.

EXAMPLE 1

Synthesis Example 1 (Synthesis Example of Exemplified Compound T83)

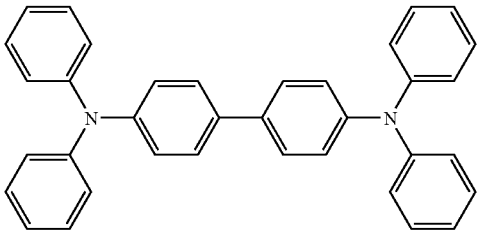

Dissolved in 40 ml of dimethylformamide were 10 g of the compound represented by the aforesaid formula, and the resulting solution was heated to 40° C. Subsequently, 9.2 g of phosphorous oxychloride were gradually added dropwise (the temperature of the resulting mixture increased to the range between 40 and 70° C. due to heat generation). The reaction composition was stirred for 3 hours while maintaining the temperature at about 70° C. After cooled to 40° C., any excessive phosphorous oxychloride sufficiently underwent hydrolysis and deposited crystals were separated by filtration. The resultant crystals were washed while suspended in water and washing was repeated until the washing water became neutral, whereby 9.25 g (85 percent) bisformyl compound, represented by the structural formula described below, were prepared.

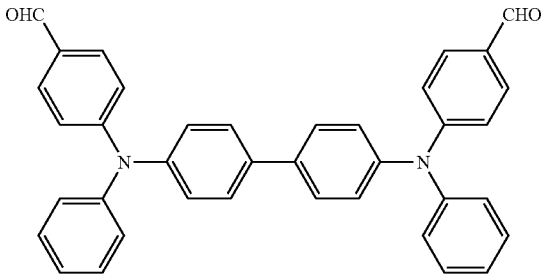

Dissolved in 50 ml of tetrahydrofuran were 4 g of bisformyl compound prepared as above and 9.3 g of cinnamyltriphosphonium bromide. While maintaining the reaction composition at about 20° C., 1.7 g of sodium methoxide were gradually added (while exhibiting heat generation). After stirring for two hours, 30 ml of water were added and a purification process was performed employing a conventional method, whereby 3.37 g (62 percent) of yellow crystals were obtained. The resultant compound was subjected to elemental analysis as well as mass spectrometry and the results shown in Table 1 were obtained, and was conformed to be Exemplified Compound T83.

Elemental analysis ($C_{56}H_{40}N_2$)

TABLE 1

| | C (percent) | H (percent) | N (percent) |
|---|---|---|---|
| Calculated Value | 90.81 | 5.41 | 3.78 |
| Measured Value | 90.70 | 5.54 | 3.75 |

Mass spectrometry ($C_{56}H_{40}N_2$)

Mw (calculated value)=740

$Mw^{+}$ (measured value)=740

Compound T83, which was prepared employing the aforesaid synthesis, was designated as T83-1. Compound T83-1 was subjected to liquid chromatography (HPCL). The measurement results showed that the mixing ratio of cis-cis/cis-trans-trans was 1.7/3.0/1.0. Incidentally, the structural formulas of T83 cis-cis and T83 trans-trans are shown below.

Measurement Conditions of Liquid Chromatography

Measurement apparatus: Shimazu LC6A (produced by Shimazu Seisakusho)

Column: CLC-SIL (produced by Shimazu Seisakusho)

Detection wavelength: 290 nm

Moving phase: n-hexane/dioxane=10 to 500/1

Flow rate of the moving phase: approximately 1 ml/minute

Sample (T83) solvents: n-hexane/dioxane=10/1

Sample (T83): 3 mg/10 ml of solvents (1) Structural Formula of T83trans-trans

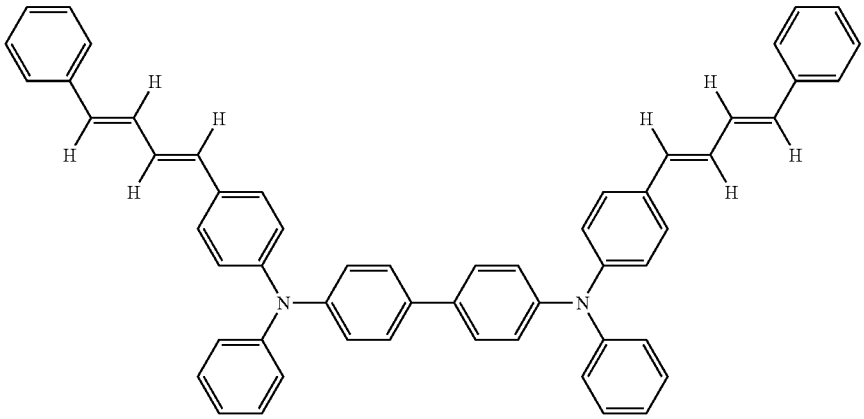

(2) Structural formula of T83cis-cis

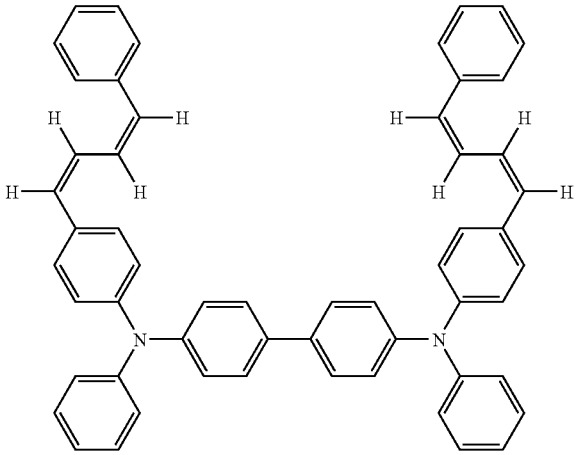

T83-1 was subjected to separation utilizing liquid chromatography, whereby a compound having a ciscis structure, a compound having a cis-trans structure, and a compound having a cistrans structure were obtained. Compound T83, having a cis-cis structure was designated as T83c-c, Compound T83 having a cis-trans structure was designated as, T83C-T and Compound T83 having a trans-trans structure was designated as T83-t-t. Compounds T83-2 through, T83-8 having a mixing ratio of cis-cis/cis-trans/trans-trans, shown in Table 2, were prepared employing four compounds consisting of T83-l, T83c-c, T83c-t, and T83-t-t.

Preparation of Photoreceptor 1

| <Interlayer> | |
|---|---|
| Titanium oxide SMT500SAS (first: silica-alumina treatment, second: methylhydrogenpolysiloxane treatment, produced by TAYCA Corporation) | 300 g |
| Polyamide resin CM8000 (manufactured by Toray Industries Inc.) | 100 g |
| Methanol | 1000 g |

Aforesaid titanium oxide, polyamide resins and methanol were placed in one vessel and the mixture was subjected to dispersion employing an ultrasonic homogenizer, whereby an interlayer coating composition was prepared. Subsequently, a cylindrical aluminum base body was subjected to dip coating and the coating was thermally cured at 110° C. for one hour, whereby an interlayer having a dried layer thickness of 4 μm was provided.

| <Charge Generating Layer> | |
|---|---|
| Y type titanyl phthalocyanine (having a maximum peak angle of X-ray diffraction employing Cu-Kα characteristic X-ray of 27.3 in terms of 2θ) | 60 g |
| Silicone modified butyral resin (X-40-1211M, produced by Shin-Etsu Kagaku Co.) | 700 g |
| 2-Butanone | 2000 ml |

were mixed. The resulting mixture was dispersed for 10 hours employing a sand mill, whereby a charge generating layer coating composition was prepared. The resulting coating composition was applied onto the aforesaid interlayer, employing a dip coating method, and a charge generating layer having a dried layer thickness of 0.2 μm was formed.

| <Charge Transport Layer> | |
|---|---|
| Charge transport material (T83-1) | 225 g |
| Polycarbonate Z (polycarbonate having the structural formula described below, having a viscosity average molecular weight of 30,000) | 300 g |
| Antioxidant (Exemplified Compound 1–3) | 6 g |
| Dichloromethane | 2000 ml |

were mixed and dissolved, whereby a charge transport layer coating composition was prepared. The resulting coating composition was applied onto the aforesaid charge generating layer, employing a dip coating method and subsequently dried for 60 minutes at 100° C., whereby a charge transport layer having a dried layer thickness of 24 μm was formed and Photoreceptor 1 was prepared.

Polycarbonate Z

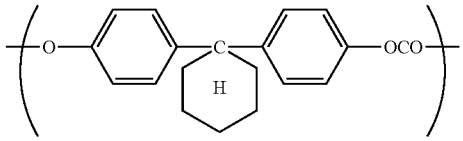

Preparation of Photoreceptors 2 through 6

Photoreceptors 2 through 6 were prepared in the same manner as Photoreceptor 1, except that the amount of the charge transport material (T83-1), employed in Photoreceptor 1, was varied as shown in Table 2.

Preparation of Photoreceptors 7 through 14

Photoreceptors 7 through 14 were prepared in the same manner as Photoreceptor 1, except that charge transport material (T83-1) employed in Photoreceptor 1 was replaced with (T83-2) through (T83-8) and (T83c-c), and the amounts were varied as shown in Table 2.

TABLE 2

| Photoreceptor No. | Charge Transport Material | cis-cis/cis-trans/trans-trans | *2 | Amount of Charge Transport Material (g) | Binder Resin (viscosity average olecular-weight) | Binder Tgb (° C.) | CTL Tgl (° C.) | ΔT (° C.) |
|---|---|---|---|---|---|---|---|---|
| Photoreceptor 10 | T83-1 | 1.7/3.0/1.0 | 52.6 | 225 | Polycarbonate Z (30,000) | 182 | 78 | 104 |
| Photoreceptor 20 | T83-1 | 1.7/3.0/1.0 | 52.6 | 200 | Polycarbonate Z (30,000) | 182 | 92 | 90 |
| Photoreceptor 21 | T83-1 | 1.7/3.0/1.0 | 52.6 | 135 | Polycarbonate Z (30,000) | 182 | 128 | 54 |
| Photoreceptor 22 | T83-1 | 1.7/3.0/1.0 | 52.6 | 90 | Polycarbonate Z (30,000) | 182 | 136 | 46 |
| Photoreceptor 23 | T83-1 | 1.7/3.0/1.0 | 52.6 | 60 | Polycarbonate Z (30,000) | 182 | 148 | 34 |
| Photoreceptor 24 | T83-1 | 1.7/3.0/1.0 | 52.6 | 30 | Polycarbonate Z (30,000) | 182 | 169 | 13 |
| Photoreceptor 25 | T83-2 | 1.7/1.8/1.3 | 37.5 | 180 | Polycarbonate Z (30,000) | 182 | 106 | 76 |
| Photoreceptor 26 | T83-3 | 1.7/2.1/1.3 | 41 | 135 | Polycarbonate Z (30,000) | 182 | 130 | 52 |
| Photoreceptor 27 | T83-4 | 1.7/5.0/1.0 | 65 | 135 | Polycarbonate Z (30,000) | 182 | 132 | 50 |
| Photoreceptor 28 | T83-5 | 16.3/3.0/1.0 | 80 | 135 | Polycarbonate Z (30,000) | 182 | 133 | 49 |
| Photoreceptor 29 | T83-6 | 1.7/3.0/37.0 | 88.7 | 135 | Polycarbonate Z (30,000) | 182 | 133 | 49 |
| Photoreceptor 30 | T83-7 | 37/1.5/1.5 | 92.5 | 135 | Polycarbonate Z (30,000) | 182 | 136 | 46 |
| Photoreceptor 31 | T83-8 | 1.5/37/1.5 | 92.5 | 135 | Polycarbonate Z (30,000) | 182 | 134 | 48 |
| Photoreceptor 32 | T83c-c | 1.0/0.0/0.0 | 100 | 135 | Polycarbonate Z (30,000) | 182 | 140 | 42 |

*2: Content Ratio of Isomer Component in the Highest Amount (in weight percent)

In Table 2, ΔT represents the difference between Tgb and Tgl.

Evaluation

Employed as an apparatus for evaluation was a digital copier, Konica 7075, (comprising processes to form double sided images, utilizing corona charging, laser exposure, reversal development, electrostatic transfer, claw separation, blade cleaning, cleaning rollers, and an electronic RDH). Cleaning properties as well as resulting images were evaluated as follows. Each of Photoreceptors 1 through 14 was installed in the aforesaid copier. An original document comprising images consisting of equal quarters of a text image having a pixel ratio of 7 percent, a portrait, a solid white image, and a solid black image was subjected to double sided copying, employing A4 neutralized paper sheets. Copying was carried out under two conditions, that is, a severe condition of high temperature and high humidity (30° C. and 80 percent relative humidity) and low temperature and low humidity (10° C. and 30 percent relative humidity). At each condition, 10,000 sheets were continuously printed, and halftone images, solid white images and solid black images were prepared. The resulting images were evaluated as follows.

Evaluation Criteria

Image density was determined employing RD-918 produced by Macbeth Corp. The resulting density was represented as relative density while the reflection density of the paper sheet was "0". Evaluation was carried out employing the initial image and each image after printing 10,000 sheets.

A: density of the solid black image was at least 1.2 (good)

B: density of the solid black image was from 1.0 to 1.2 (commercially acceptable)

C: density of the solid black image was less than 1.0 (commercially unacceptable)

Background stain was visually evaluated employing the solid white image at the start and after printing 10,000 sheets.

A: no background stain occurred at either ambient conditions (good)

B: background stain occurred at a density of 0.01 to 0.02 at one of the ambient conditions (commercially acceptable)

C: background stain occurred at a density of at least 0.03 at one of the ambient conditions (commercially unacceptable)

Resolution was evaluated based on ease of readability of the text image.

After printing 10,000 sheets as stated above, 3-point and 5-point text images were prepared and evaluated based on the criteria described below.

A: 3-point and 5-point text images were clear and easily readable (good)

B: 3-point text images were partially unreadable; while 5-point text images were clear and easily readable (commercially acceptable)

C: 3-point text images were barely readable, and 5-point text images also were partly or wholly unreadable (commercially unacceptable)

Black spots were evaluated employing solid white images at the start and after printing 10,000 sheets.

Black spots were evaluated based on the number of visible black spots per A4 size sheet, of which cyclic formation matched the cyclic rotation of the photoreceptor.

A: number of black spots having a size of at least 0.4 mm: at most 3/A4 in all copied images (good)

B: number of black spots having a size of at least 0.4 mm: formation of at least one sheet having 4 to 19/A4 (commercially acceptable)

C: number of black spots having a size of at least 0.4 mm: formation of at least one sheet having at least 20/A4 (commercially unacceptable)

White undeveloped spots were evaluated employing the halftone images at the start and after printing 10,000 sheets.

White undeveloped spots were evaluated based on the number of white undeveloped black spots per A4 size sheet, of which cyclic formation matched the cyclic rotation of the photoreceptor.

A: number of white undeveloped spots having a size of at least 0.4 mm: at most 3/A4 in all copied images (good)

B: number of white undeveloped spots having a size of at least 0.4 mm: formation of at least one sheet having 4 to 19/A4 (commercially acceptable)

C: number of white undeveloped spots having a size of at least 0.4 mm: formation of at least one sheet having at least 20/A4 (commercially unacceptable)

Cracks

At the aforesaid ambience of 30° C. and 80 percent relative humidity, the photoreceptor which completed double sided printing of 10,000 sheets remained installing in the digital copier, Konica 7075, and power was turned off. Thereafter, the photoreceptor sat idle for two days. Members around the photoreceptor were kept in the state in which each operation was suspended, namely members such as the cleaning blade, the cleaning roller, and the developer transporting body were brought into contact with the photoreceptor. Thereafter, the presence or absence of crack formation was inspected. Further, image formation (for the inspection of image problems such as streaks due to cracks on images) was carried out. Evaluation was performed based on the criteria described below.

A: neither cracks nor streak-like image problems occurred (good)

B: minute cracks occurred, but no streak-like image problems occurred (commercially acceptable)

C: cracks occurred and streak-like image problems also occurred (commercially unacceptable)

Other Evaluation Conditions

Other evaluation conditions which had been applied to the aforesaid digital copier, Konica 7075, were set as described below.

Charging Conditions

Charging unit: Scorotron charging unit, initial charge potential at −750 V

Exposure Conditions

Semiconductor laser at 780 nm was employed as an exposure light source.

Development Conditions

Employed as a developer was one comprising toner which consisted of a carrier prepared by coating insulation resins onto ferrite as a core, and toner prepared by externally adding silica and titanium oxide to colored particles comprised of colorants comprising carbon black employing styrene acryl based resins as a main material, charge control agents, and low molecular weight polyolefin of the present invention.

Transfer Conditions

Transfer electrode: corona charging system

Cleaning Conditions

A cleaning unit was brought into contact with a cleaning blade having a hardness of 70°, a repulsive elasticity of 34 percent, a thickness of 2 mm, and a free length of 9 mm in the counter direction so as to result in a linear pressure of 20 N/m, employing a weight loading system.

Cleaning roller: A roller was employed of which surface was covered with blowing urethane resins.

Table 3 shows the results.

TABLE 3

| Photoreceptor No. | Image Density | Background Stain | Resolution | Black Spots | White Undeveloped Spots | Crack | Remarks |
|---|---|---|---|---|---|---|---|
| | Image Evaluation | | | | | | |
| Photoreceptor 1 | B | B | C | B | C | A | |
| Photoreceptor 2 | B | B | C | B | B | A | |
| Photoreceptor 3 | A | A | A | A | A | A | Inv. |
| Photoreceptor 4 | A | A | A | A | A | A | Inv. |
| Photoreceptor 5 | A | A | A | A | A | A | Inv. |
| Photoreceptor 6 | B | A | A | A | A | A | Inv. |
| Photoreceptor 7 | A | A | A | B | A | A | Inv. |
| Photoreceptor 8 | A | A | A | A | A | A | Inv. |
| Photoreceptor 9 | A | A | A | A | A | A | Inv. |
| Photoreceptor 10 | A | A | A | A | A | A | Inv. |
| Photoreceptor 11 | A | A | A | A | A | A | Inv. |
| Photoreceptor 12 | B | A | B | A | B | B | Inv. |
| Photoreceptor 13 | B | A | B | A | B | B | Inv. |
| Photoreceptor 14 | B | C | C | C | B | C | |

Inv.: Present Invention

As can clearly be seen from Table 3, Photoreceptors 3 through 13, which comprised charge transport materials comprised of a mixture of stereoisomers and had a Tgl of 106 to 169° C., being higher than 100° C., exhibited excellent image characteristics such as image density, background stain, and resolution and minimized image problems such as black spots, white undeveloped spots, and cracks. Accordingly, they exhibited improved characteristics compared to Photoreceptors 1, 2, and 14 which were not included in the present invention. Specifically, Photoreceptors 3 through 6 and 8 through 11, in which the ratio of the isomer component in the maximum amount was in the range of 40 to 90 percent, exhibited pronounced desired effects. On the other hand, in Photoreceptors 1 and 2, having a Tgl of 78° C. and 92° C., respectively, which were not included in the present invention, resulted in increase in white undeveloped spots as well as black spots and degradation of resolution. Further, Photoreceptor 14, in which the charge transport material was not a mixture of stereoisomers, resulted in an increase in white undeveloped spots as well as black spots, crack formation, and decrease in resolution.

EXAMPLE 2

Synthesis Example 2 (Synthesis Example of Exemplified Compound T74)

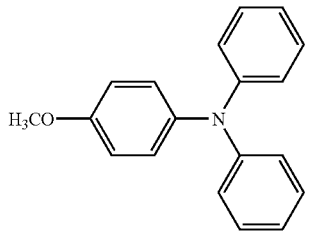

Charged into a four-necked flask fitted with a cooling pipe and a thermometer under a flow of $N_2$ gas were 20 g of the aforesaid 4-methoxytriphenylamine, 32 g of dimethylformamide, and 80 ml of toluene, and the resulting mixture was mixed. While keeping at 60 to 70° C., 76.02 g of phosphorus trichloride were gradually dripped. Thereafter, the resulting mixture underwent reaction at approximately 70° C. for 20 hours. After the reaction, the inner temperature was decreased to approximately 50° C., and subsequently, 500 ml of water at 60 to 70° C. was gradually dripped (attention was paid so that the inner temperature did not exceed 70° C.). After stirring for one hour, 400 ml of toluene were added and washing was carried out until the resulting washing water became neutral in pH. After concentration, recrystallization was performed employing isopropyl alcohol, whereby 16.46 g (64 percent) of 4,4'-diformyl-4"-methoxyphenylamine were prepared. Mass spectrometry resulted in $Mw^{+=}331$.

Subsequently, 15.6 g of magnesium and 20 ml of tetrahydrofuran were mixed under an atmosphere of nitrogen, and reaction was initiated by the addition of ethyl iodide and iodine in a small amount. A solution prepared by dissolving 111.15 g of p-bromotoluene in 500 ml of tetrahydrofuran was dripped between room temperature and 40° C. over a period of approximately two hours, whereby a Grignard reagent was prepared. Subsequently, a solution prepared by dissolving 83.75 g of p-methylacetophenone in 200 ml of tetrahydrofuran was dripped into the aforesaid Grignard reagent between room temperature and 40° C. over a period of approximately three hours. After stirring at room temperature for three hours, the resulting mixture was refluxed for four hours.

After cooling the resulting reaction composition,. hydrolysis was carried out by injecting 1.0 L of a 5 percent aqueous sulfuric acid solution.

The resulting composition was extracted using toluene. After washing the extract until the pH reached 7 and subsequently performing concentration, 300 ml of toluene and 0.5 g of p-toluenesulphonic acid were added and the resulting mixture underwent dehydration while being refluxed. Thereafter, washing and concentration were carried out. The resulting crude product was subjected to low pressure distillation (b.p. 120 to 121° C./133 Pa), whereby 95.5 g (73.5 percent) of 1,1-di(p-tolyl)ethylene were obtained.

Subsequently, 62.76 g of the resulting 1,1-di(p-tolyl) ethylene, 108.26 g of acetic acid, and 13.51 g of paraformaldehyde were mixed. While stirring at 30° C., 13.67 g of hydrogen chloride were blown through over a period of 3.5 hours. After blowing, the resulting mixture was stirred at 30° C. for two hours and subsequently set aside over night. Subsequently, a reaction composition was poured into 200 ml of water. Extraction was then carried out employing 200 ml of toluene. The resulting extract was washed until the resulting washing water became neutral in pH and was subjected to concentration after drying, employing magnesium sulfate. The resulting crude product was subjected to low pressure distillation (b.p. 120 to 132° C./133 Pa), whereby 47.7 g (62 percent) of 3,3-(p-tolyl)allyl chloride were obtained. Mass spectrometry resulted in $Mw^{+}$=257.

Subsequently, 30 g of the resulting 3,3-(p-tolyl)allyl chloride and 58.3 g of triethyl phosphite were mixed and the resulting mixture was refluxed for 10 hours while heated. After removing excessive triphenyl phosphite through distillation, recrystallization was carried out employing hexane, whereby 24.7 g (59.9 percent) of 3,3-di(p-tolyl)allyl phosphite diethyl ester was obtained. Mass spectrometry resulted in $Mw^{+}$=358.

Under an atmosphere of nitrogen gas, 3.31 g of 4,4'-diformyl-4"-methoxyphenylamine, which had been synthesized, and 7.52 g of 3,3-di(p-tolyl)allyl phosphite diethyl ester were dissolved in 30 ml of toluene. Subsequently, 2.56 g of potassium tert-butoxide were gradually added so that the temperature of the reaction composition did not reach higher than or equal to 400° C., and reaction was performed at room temperature for 5 hours. Thereafter, 500 ml of methanol and 30 ml of water were added to the reaction composition, and deposited crystals were collected through filtration. Recrystallization was then performed employing a solvent mixture consisting of acetonitrile/ethyl acetate=2/1, whereby 6.15 g (83.2 percent) of Exemplified Compound T74 were prepared. The resulting compound was subjected to elemental analysis as well as mass spectrometry. The results shown in Table 4 were obtained and the resulting compound was confirmed to be emplified Compound T74.

TABLE 4

| | C (percent) | H (percent) | N (percent) |
|---|---|---|---|
| Calculated Value | 89.31 | 6.63 | 1.89 |
| Measured Value | 89.27 | 6.65 | 1.85 |

Mass spectrometry ($C_{55}H_{49}NO$)

Mw (calculated value)=739

$Mw^{+}$ (*measured value*)=739

Compound, T74 synthesized as above, was designated as T74-1. Compound T74-1 was subjected to the aforesaid liquid chromatography (HPCL). The results showed that the mixing ratio of cis-cis/trans-trans was ½. Incidentally, the structural formulas of T74 cis-cis and T74 trans-trans are shown below.

1T74 trans-trans Formula (1) T4trans-trans Formula

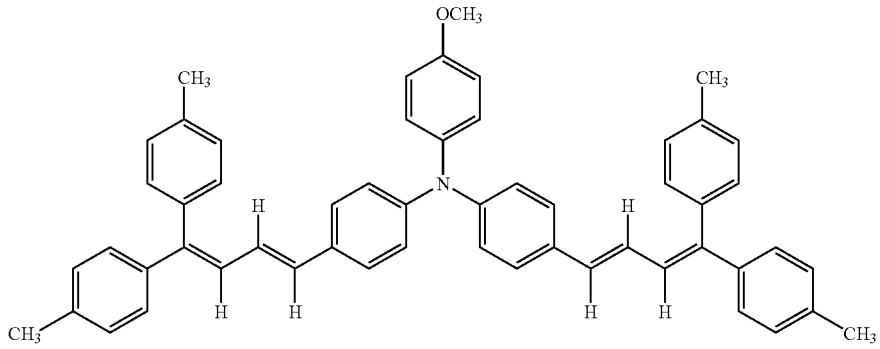

1T74 cis-cis Formula

T74-1 prepared as above was separated into a compound having a cis-cis formula as well as a compound having the transtrans formula, employing liquid chromatography. The resulting compound having the cis-cis formula was designated as, T74c-c while the resulting compound having the trans-trans formula was designated as T74t-t. By employing three compounds of T74, T74t-t, and T74c-c, Compounds (T74-2) through (T74-8) were prepared in such a manner that the mixing ratio of cis-cis/trans-trans was varied as shown in Table 5.

Preparation of Photoreceptors 15 through 24

Photoreceptors 15 through 24 were prepared in the same manner as Photoreceptor 1, except that charge transport material (T83-1) employed in Photoreceptor 1 was replaced with each of (T74-1) through (T74-8) and the mixing ratio of isomers was varied as shown in Table 5.

(2) T4cis-cis Formula

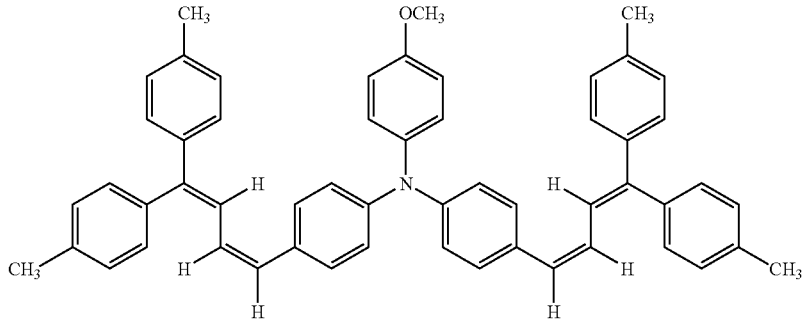

TABLE 5

| Photoreceptor No. | Charge Transport Material | cis-cis/ trans-trans | Content Ratio of Isomer Component in the Maximum Amount (weight %) | Weight of Charge Transport Material (g) | Binder Resin (Viscosity Average Molecular Weight) | Binder Tgb (° C.) | CTL Tgl (° C.) | ΔT (° C.) |
|---|---|---|---|---|---|---|---|---|
| Photoreceptor 15 | T74-1 | 1/2 | 66 | 135 | Polycarbonate Z (30,000) | 182 | 124 | 58 |
| Photoreceptor 16 | T74-2 | 1/1 | 50 | 160 | Polycarbonate Z (30,000) | 182 | 112 | 70 |
| Photoreceptor 17 | T74-3 | 1/3 | 75 | 135 | Polycarbonate Z (30,000) | 182 | 138 | 44 |
| Photoreceptor 18 | T74-4 | 1/6 | 86 | 170 | Polycarbonate Z (30,000) | 182 | 108 | 74 |
| Photoreceptor 19 | T74-5 | 3/1 | 75 | 135 | Polycarbonate Z (30,000) | 182 | 136 | 46 |
| Photoreceptor 20 | T74-6 | 7/1 | 88 | 135 | Polycarbonate Z (30,000) | 182 | 140 | 42 |
| Photoreceptor 21 | T74-7 | 10/1 | 91 | 90 | Polycarbonate Z (30,000) | 182 | 150 | 32 |
| Photoreceptor 22 | T74-8 | 1/10 | 91 | 90 | Polycarbonate Z (30,000) | 182 | 152 | 30 |
| Photoreceptor 23 | T74-1 | 1/2 | 66 | 180 | Polycarbonate Z (30,000) | 182 | 95 | 87 |
| Photoreceptor 24 | T74t-t | 0/1 | 100 | 135 | Polycarbonate Z (30,000) | 182 | 146 | 36 |

In Table 5, ΔT shows the difference between Tgb and Tgl.

The aforesaid Photoreceptors 15 through 24 were evaluated in the same manner as Example 1. Table 6 shows the results.

TABLE 6

| | Image Evaluation | | | | | | |
|---|---|---|---|---|---|---|---|
| Photoreceptor No. | Image Density | Background Stain | Resolution | Black Spots | White Undeveloped Spots | Crack | Remarks |
| Photoreceptor 15 | A | A | A | A | A | A | Inv. |
| Photoreceptor 16 | B | A | A | A | B | A | Inv. |
| Photoreceptor 17 | A | A | A | A | A | A | Inv. |
| Photoreceptor 18 | B | B | A | B | B | A | Inv. |
| Photoreceptor 19 | A | A | A | A | A | A | Inv. |

TABLE 6-continued

| Photoreceptor No. | Image Density | Background Stain | Resolution | Black Spots | White Undeveloped Spots | Crack | Remarks |
|---|---|---|---|---|---|---|---|
| | Image Evaluation | | | | | | |
| Photoreceptor 20 | A | A | A | A | A | A | Inv. |
| Photoreceptor 21 | B | A | B | A | B | B | Inv. |
| Photoreceptor 22 | B | A | B | A | B | B | Inv. |
| Photoreceptor 23 | B | C | C | C | C | A | |
| Photoreceptor 24 | B | C | C | C | C | C | |

Inv.: Present Invention

As can clearly be seen from Table 6, Photoreceptors 15 through 22, which comprised charge transport materials comprised of a mixture of stereoisomers and had a Tgl higher than or equal to 100° C., exhibited excellent image characteristics such as image density, background stain, and resolution and minimized image problems such as black spots, white undeveloped spots, and cracks. Accordingly, they were improved compared to Photoreceptors 23 and 24 which are not included in the present invention. Specifically, Photoreceptors 15 through 20, in which the ratio of the isomer component in the maximum amount was in the range of 40 to 90 percent, exhibited pronounced desired effects. On the other hand, in Photoreceptor 23, having a Tgl of 87° C., which was not included in the present invention, resulted in an increase in white undeveloped spots as well as black spots and degradation of resolution. Further, Photoreceptor 24, in which the charge transport material was not a mixture of stereoisomers, resulted in an increase in white undeveloped spots as well as black spots, crack formation, and a decrease in resolution.

EXAMPLE 3

Synthesis Example 3 (Synthesis Example of Exemplified Compound T20)

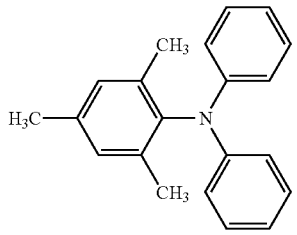

Dissolved in 32 g of phosphorus oxychloride were 10 g of the compound represent by the formula described above, and the resulting solution was heated to 50° C. Subsequently, 22 ml of dimethylformamide were gradually dripped (the temperature of the resulting mixture increased between 40 and 70° C. due to heat generation). The reaction composition was stirred for 15 hours while controlling the temperature at approximately 90° C. After the temperature was allowed to lower itself to 40° C., the residual phosphorus oxychloride was completely hydrolyzed, and deposited crystals were collected through filtration and then suspended in water. The collected crystals were washed with water while suspended and washing was repeated until the resulting washing water became neutral in pH, whereby 9.25 g (77 percent) of the bisformyl compound represented by the structural formula described below was obtained.

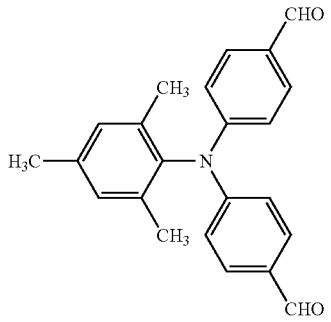

Dissolved in 20 ml of dimethylformamide were 2 g bisformyl compound prepared as above and 4.3 g of the phosphonate compound represented by the structural formula described below. While maintaining the reaction composition at approximately 20° C., 1.0 g of sodium methoxide was gradually added (resulting in heat generation). After stirring for 4 hours, 30 ml of water were added and purification was performed employing a conventional method, whereby 3.3 g of yellow crystals were prepared. The resulting crystals were subjected to elemental analysis as well as mass spectrometry and the results shown in Table 7 were obtained. Based on the results, the prepared compound was confirmed to be Exemplified Compound T20.

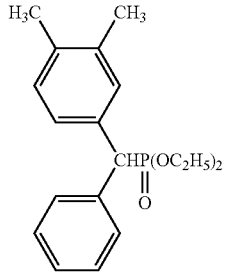

Elemental analysis ($C_{53}H_{49}N$)

TABLE 7

| | C (percent) | H (percent) | N (percent) |
|---|---|---|---|
| Calculated Value | 90.99 | 7.01 | 2.00 |
| Measured Value | 90.90 | 7.04 | 1.97 |

Mass spectrometry ($C_{53}H_{49}N$)

Mw (calculated value)=699

$Mw^{+}$ (*measured value*)=699

Compound T20 synthesized as described above was designated as T20-1. Compound T20 was analyzed employing liquid chromatography (HPCL) described below. The analytical results showed that the mixing ratio of cis-cis/cis-trans/trans-trans was 1.1/2.2/1.0. Incidentally, structural formulas of T20cis-cis, T20trans-trans, and T20cis-trans are shown below.

Measurement Conditions of Liquid Chromatography

Measurement apparatus: Shimazu LC6A (produced by Shimazu Seisakusho)

Column: CLC-SIL (produced by Shimazu Seisakusho)

Detection wavelength: 290 nm

Moving phase: n-hexane/dioxane=10 to 500/1

Flow rate of the moving phase: approximately 1 ml/minute

Sample (T20) solvents: n-hexane/dioxane=10/1

Sample (T20): 3 mg/10 ml of solvents (1) Structural Formula of T20cis-cis

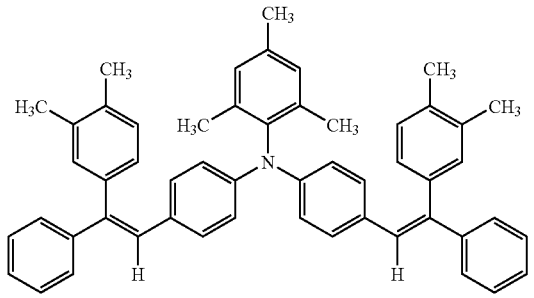

-continued (2) Structural Formula of T20trans-trans

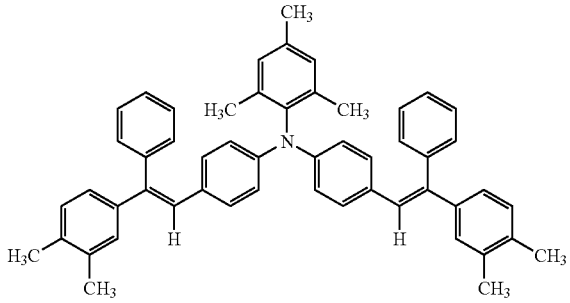

(3) Structural formula of T20cis-trans

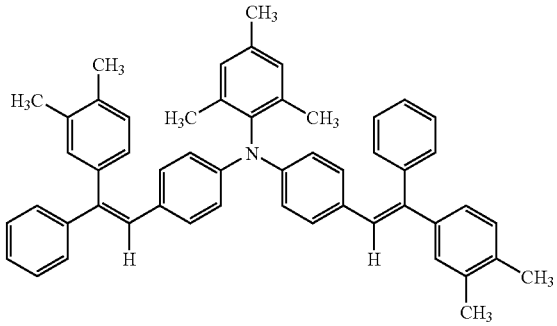

T20-1 prepared as described above was subjected to separation utilizing liquid chromatography, whereby a compound having a cis-cis structure, a compound having a cis-trans structure, and a compound having a trans-trans structure were obtained. Compound T20 having a cis-cis structure was designated as T20c-c, Compound T20 having a cis-trans structure was designated as T20c-t, and Compound T20 having a trans-trans structure was designated as T20t-t. Compounds T20-2 through T20-8 having a mixing ratio of cis-cis/cis-trans/trans-trans, shown in Table 2, were prepared employing four compounds consisting of T20-1, T20c-c, T20c-t, and T20t-t.

Preparation of Photoreceptor 201

| <Interlayer> | |
|---|---|
| Titanium oxide SMT500SAS (first: silica-alumina treatment, second: methylhydrogenpolysiloxane treatment, having a titanium oxide particle diameter of 35 nm, produced by TAYCA Corporation.) | 300 parts |
| Polyamide resin CM8000 (manufactured by Toray Industries Inc.) | 100 parts |
| Methanol | 1000 parts |

Aforesaid titanium oxide, polyamide resins and methanol were placed in the same vessel and the mixture was subjected to dispersion employing an ultrasonic homogenizer, whereby an interlayer coating composition was prepared. Subsequently, a cylindrical aluminum base body was subjected to dip coating, employing the resulting coating composition and the coating was thermally cured at 110° C. for one hour, whereby an interlayer having a dried layer thickness of 4 μm was provided.

| <Charge Generating Layer> | |
|---|---|
| Y type titanyl phthalocyanine (having a maximum peak angle of X-ray diffraction employing Cu-Kα characteristic X-ray of 27.3 in terms of 2θ) | 60 parts |
| Silicone modified butyral resin (X-40-1211M, produced by Shin-Etsu Kagaku Co.) | 700 parts |
| 2-Butanone | 2000 parts |

were mixed. The resulting mixture was dispersed for 10 hours employing a sand mill, whereby a charge generating layer coating composition was prepared. The resulting coating composition was applied onto the aforesaid interlayer employing a dip coating method, and a charge generating layer having a dried layer thickness of 0.2 μm was formed.

| <Charge Transport Layer> | |
|---|---|
| Charge transport material (T20-1) | 225 parts |
| Polycarbonate (having a viscosity average molecular weight of 20,000) | 300 parts |
| Antioxidant (Exemplified Compound 1-3) | 6 parts |
| Dichloromethane | 2000 parts |

were mixed and dissolved, whereby a charge transport layer coating composition was prepared. The resulting coating composition was applied onto the aforesaid charge generating layer, employing a dip coating method, whereby a charge transport layer having a dried layer thickness of 24 μm was formed and Photoreceptor 1 was prepared.

Preparation of Photoreceptors 202 through 209

Photoreceptors 202 through 206 were prepared in the same manner as Photoreceptor 1, except that charge transport material (T20-1) employed in Photoreceptor 201 was replaced with each of T20-2 through T20-8 and T20t-t, and the mixing ratio of isomers was varied as shown in Table 8.

TABLE 8

| Photoreceptor No. | Charge Transport Material | cis-cis/ cis-trans/ trans-trans | Content Ratio of Isomer Component in the Maximum Amount (weight percent) |
|---|---|---|---|
| Photoreceptor 1 | T20-1 | 1.1/2.2/1.0 | 51 |
| Photoreceptor 2 | T20-2 | 1.7/2.1/1.3 | 41 |
| Photoreceptor 3 | T20-3 | 1.7/1.8/1.3 | 37.5 |
| Photoreceptor 4 | T20-4 | 16.0/3.0/1.0 | 80 |
| Photoreceptor 5 | T20-5 | 1.7/5.0/1.0 | 65 |
| Photoreceptor 6 | T20-6 | 1.7/3.0/37.0 | 88.7 |
| Photoreceptor 7 | T20-7 | 37/1.5/1.5 | 92.5 |
| Photoreceptor 8 | T20-8 | 1.5/37/1.5 | 92.5 |
| Photoreceptor 9 | T20t-t | 0/0/1 | 100 |

Preparation of Toner and Developer (Toner Production Example 1: Example of Emulsion Polymerization Coalescence Method)

While stirring, 0.90 kg of sodium n-dodecylsulfate was dissolved in 10.00 liters of pure water. Gradually added to the resulting solution were 1.20 kg of Regal 330R (carbon black produced by Cabot Corp). After stirring well for one hour, the resulting mixture was continuously dispersed for 20 hours employing a sand grinder (a medium type homogenizer). The resulting dispersion was designated as "Colorant Dispersion 1".

Further, a solution comprised of 0.055 kg of sodium dodecylbenznesulfonate and 4.0 liters of ion-exchange water was designated as "Initiator Solution C".

A solution comprised of 0.014 kg of nonylphenolpolyethylene oxide 10 mol addition compound and 4.0 liters of ion-exchange water was designated as "Nonionic Surface Active Agent Solution B".

A solution prepared by dissolving 223.8 g of potassium persulfate in 12.0 liters of ion-exchange water was designated as "Initiator Solution C".

Charged into 100-liter capacity GL (glass lining) reaction vessel, fitted with a thermal sensor, a cooling pipe, and a nitrogen inlet device, were 3.41 kg of a WAX emulsion (polypropylene emulsion having a number average molecular weight of 3,000, a number average primary particle diameter of 120 nm and a solid concentration of 29.9 percent), the total amount of "Anionic Surface Active Agent A", and the total amount of "Nonionic Surface Active Agent B". Stirring was then initiated. Subsequently, 44.0 liters of ion-exchange water were added.

Subsequently, the resulting mixture was heated. When its temperature reached 75° C., the total amount of "Initiator Solution C" was dripped into it. Thereafter, controlling the liquid composition at 75±1° C., 12.1 kg of styrene, 2.88 kg of n-butyl acrylate, 1.04 kg of methacrylic acid, and 548 g of t-dodecylmercaptan were dripped. After the dripped addition, the resulting liquid composition was heated to 80±1° C. and stirred for 6 hours while being heated. Subsequently, the temperature of the resulting liquid composition was lowered to less than or equal to 40° C. and stirring was terminated. A latex was obtained through pore filter filtration. The resulting latex was designated as "Latex-A".

Incidentally, resinous particles in Latex-A have a glass transition temperature of 57° C., a softening point of 121° C., and a molecular weight distribution such as a weight average molecular weight of 12,700 and a weight average particle diameter of 120 nm.

A solution prepared by dissolving 0.055 kg of sodium dodecylbenzenesulfonate in 4.0 liters of ion-exchange water was designated as "Anionic Surface Active Agent Solution D".

Further, a solution prepared by dissolving 0.014 kg of nonylphenolpolyethylene oxide 10-mol addition product in 4.0 liters of ion-exchange water was designated as "Nonionic Surface Active Agent Solution E".

A solution prepared by dissolving 200.7 g of potassium persulfate in 12.0 liters of ion-exchange water was designated as "Initiator Solution F".

Charged into a 100-liter GL reaction vessel, fitted with a thermal sensor, a cooling pipe, a nitrogen inlet device, and a comb-shaped baffle were 3.41 kg of a WAX emulsion (polypropylene emulsion having a number average molecular weight of 3,000, a number average primary particle diameter of 120 nm and a solid concentration of 29.9 percent), the total amount of "Anionic Surface Active Agent D", and the total amount of "Nonionic Surface Active Agent E". Stirring was then initiated.

Subsequently, 44.0 liters of ion-exchange water were added, and the resulting mixture was heated. When the temperature reached 70° C., "Initiator Solution F" was dripped into the solution. Thereafter, a solution previously prepared by mixing 11.0 kg of styrene, 4.00 kg of n-butyl acrylate, 1.04 kg of methacrylic acid, and 9.02 g of t-dodecylmercaptan were added dropwise. After the dripped addition, the temperature of the resulting liquid composition was maintained at 72±2° C. and stirring was carried out for 6 hours while heated. Subsequently, the resulting liquid composition was heated to 80±2° C. and stirred for an additional 12 hours while heated at the temperature. The resulting liquid composition was lowered to less than or equal to 40° C. and stirring was terminated. A latex was obtained through pore filter filtration. The resulting latex was designated as "Latex-B".

Incidentally, resinous particles in Latex-B had a glass transition temperature of 58° C., a softening point of 132° C., and a molecular weight distribution such as a weight average molecular weight of 245,000 and a weight average particle diameter of 110 nm.

A solution prepared by dissolving 5.36 kg of sodium chloride, as a salting-out agent, in 20.0 liters of ion-exchange water was designated as "Sodium Chloride Solution G".

A solution prepared by dissolving 1.00 g of a fluorine based nonionic surface active agent in 1.00 liter of ion-exchange water was designated as "Nonionic Surface Active Agent Solution H".

Charged into a 100-liter SUS reaction vessel (a reaction apparatus structured as shown in FIG. 3, having a crossed axes angle of stirring blades, α, of 25°), fitted with a thermal sensor, a cooling pipe, a nitrogen inlet device, and a particle diameter and shape monitoring apparatus, were 20.0 kg of Latex-A and 5.3 kg of Latex-B, both prepared as above, 0.4 kg of Colorant Dispersion, and 20.0 kg of ion-exchange water, and the resulting mixture was stirred. Subsequently, while heated to 40° C., Sodium Chloride Solution G, 6.00 kg of isopropanol (produced by Kanto Kagaku), and Nonionic Surface Active Agent Solution H were added in the stated order. After being allowed to stand for 10 minutes, the resulting mixture was heated to 85° C. over a period of 60 minutes and the particle diameter was allowed to increase upon being salted-out/fused while stirring at 85±2° C. over a period of 0.5 to 3 hours (salting-out/fusion process). Thereafter, the growth in particle diameter was stopped by adding 2.2 liters of pure water, whereby a fused particle dispersion was prepared.

Charged into a 5-liter reaction vessel (a reaction apparatus of structured as shown in FIG. 3, having a crossed axes angle of stirring blades, α, of 20°), fitted with a thermal sensor, a cooling pipe, and a particle diameter and shape monitoring apparatus, were 5.0 kg of the fused particle dispersion prepared as above. Subsequently, while stirring the liquid composition at a temperature of 85±2° C. for 0.5 to 15 hours, the particle shape was regulated (shape controlling process). Thereafter, the temperature was lowered to at most 40° C. and stirring was stopped. Subsequently, by employing a centrifuge, classification was performed in the liquid medium utilizing a centrifugal sedimentation method. The resulting composition was filtered employing a 45 μm opening sieve, and the resulting filtrate was designated as a coalesced composition. Non-spherical particles in a wet cake form were collected from the coalesced composition through filtration and subsequently washed.with ion-exchange water. The resulting non-spherical particles were dried at an intake air temperature of 60° C., employing a flash air drier and subsequently dried at 60° C, employing a fluidized bed dryer. One part by weight of minute silica particles was externally added to and mixed with 100 parts by weight of the resulting colored particles, employing a Henschel mixer, whereby toner was prepared which employed an emulsion polymerization coalescence method.

Toners 1 through 16, which were comprised of toner particles having the shape characteristics as well as the particle size distribution characteristics shown in Table 9, were prepared as follows. Through monitoring of the aforesaid salting-out/fusion process and shape controlling process, the shape and the variation coefficient of the shape factor were controlled by controlling the frequency of stirring rotation and heating time, and further the particle diameter and the variation coefficient of the particle size distribution were optionally adjusted utilizing classification in a liquid medium.

TABLE 9

| Toner No. | *1 | *2 | *3 | *4 | *5 | $M(m_1 + m_2)$ (percent) |
|---|---|---|---|---|---|---|
| 1 | 68.3 | 15.2 | 88 | 5.6 | 25.9 | 80.7 |
| 2 | 73.2 | 12.2 | 94 | 8.1 | 20.7 | 82.3 |
| 3 | 65.1 | 14.8 | 52 | 4.1 | 26.6 | 71.4 |
| 4 | 63.4 | 15.7 | 51 | 5.3 | 26.1 | 70.5 |
| 5 | 67.7 | 16.8 | 53 | 5.6 | 26.5 | 72.4 |
| 6 | 67.7 | 15.2 | 46 | 5.6 | 25.9 | 80.7 |
| 7 | 74.1 | 12.4 | 89 | 5.7 | 27.8 | 71.6 |
| 8 | 65.1 | 15.0 | 51 | 5.6 | 25.6 | 67.4 |
| 9 | 60.2 | 17.2 | 53 | 5.7 | 25.8 | 70.5 |
| 10 | 66.1 | 16.9 | 42 | 5.7 | 22.0 | 79.8 |
| 11 | 65.1 | 17.7 | 55 | 5.5 | 27.7 | 71.0 |
| 12 | 67.7 | 16.8 | 53 | 5.6 | 26.2 | 68.2 |
| 13 | 62.1 | 15.1 | 40 | 7.7 | 26.0 | 68.2 |
| 14 | 62.5 | 17.2 | 53 | 8.2 | 25.8 | 67.8 |
| 15 | 60.5 | 17.8 | 42 | 5.7 | 26.2 | 68.3 |
| 16 | 61.5 | 18.0 | 44 | 8.8 | 28.4 | 65.3 |

*1: Proportion of Toner Particles having a Shape Factor of 1.2 to 1.6 (percent)
*2: Variation Coefficient of Shape Factor of Toner Particles (percent)
*3: Proportion of Toner Particles having no Corners (percent)
*4: Number Average Diameter of Toner Particles (μm)
*5: Number Variation Coefficient of Toner Particles Developers 1 through 16 used for evaluation were produced by mixing 10 parts by weight of each of Toners 1 through 16 with 100 parts by weight of a 45 μm carrier coated with a styrene-methacrylate copolymer.

Evaluation

The aforesaid Photoreceptors 201 through 209 and Developers 1 through 16 were combined as shown in Table 4. Employed as an apparatus for evaluation was a digital copier, Konica 7075, (comprising processes to form double sided images, utilizing corona charging, laser exposure, reversal development, electrostatic transfer, claw separation, blade cleaning, cleaning rollers, and an electronic RDH). Cleaning properties as well as the resulting images were evaluated as follows. An original document comprising images consisting of equal quarters of a text image having a pixel ratio of 7 percent, a portrait, a solid white image, and a solid black image was subjected to double sided copying, employing A4 neutralized paper sheets. Copying was carried out under conditions of high temperature and high humidity (30° C. and 80 percent relative humidity) which were assumed to be severest conditions during copying. Under such conditions, 20,000 sheets were continuously printed and evaluated. However, prior to printing, setting powder was sprinkled on the photoreceptor surface and the photoreceptor was subjected to running-in with a cleaning blade. Subsequently, 20,000 sheets were printed on both sides. Evaluation items and evaluation criteria are described below.

TABLE 10

| Combination No. | Photoreceptor No. | Developer No. (Toner No.) |
|---|---|---|
| 1 | 201 | 1 (1) |
| 2 | 201 | 2 (2) |
| 3 | 201 | 3 (3) |
| 4 | 201 | 4 (4) |
| 5 | 201 | 5 (5) |
| 6 | 201 | 6 (6) |
| 7 | 201 | 7 (7) |
| 8 | 201 | 8 (8) |
| 9 | 201 | 9 (9) |
| 10 | 201 | 10 (10) |
| 11 | 201 | 11 (11) |
| 12 | 201 | 12 (12) |
| 13 | 201 | 13 (13) |
| 14 | 201 | 14 (14) |
| 15 | 201 | 15 (15) |
| 16 | 201 | 16 (16) |
| 17 | 202 | 2 (2) |
| 18 | 203 | 2 (2) |
| 19 | 204 | 2 (2) |
| 20 | 205 | 2 (2) |
| 21 | 206 | 2 (2) |
| 22 | 207 | 2 (2) |
| 23 | 208 | 2 (2) |
| 24 | 209 | 2 (2) |
| 25 | 209 | 16 (16) |

Evaluation Items and Evaluation Criteria

Image density was determined employing a reflection densitometer "RD-918", produced by Macbeth Corp. The resulting density was represented as relative density while the reflection density of the paper sheet was "0". Evaluation was carried out employing the initial image and each image after printing 200,000 sheets.

A: density of both the initial image and images after printing 200,000 sheets was at least 1.2 (good)

B: density of both the initial image and images after printing 200,000 sheets was at least 1.0 (commercially acceptable)

C: density of either the initial image or images after printing 200,000 sheets was less than 1.0 (commercially unacceptable)

Background Stain was evaluated based on the density of the solid white images.

Density of a copy paper sheet, which had not been printed, was determined at 20 positions in terms of absolute image density, employing a reflection densitometer "RD-918", produced by Macbeth Corp. The average value was designated as white paper density. Subsequently, absolute image density, of the white background of the evaluation paper on which images were formed, was determined at 20 random positions. Background stain was determined by subtracting the aforesaid white paper density from the resulting average density and then evaluated.

A: background stain of both the initial print and prints after printing 200,000 sheets was less than or equal to 0.005 (good)

B: background stain of both the initial print and prints after printing 200,000 sheets was less than or equal to 0.01 (commercially acceptable)

C: background stain of either the initial print or prints after printing 200,000 sheets was at least 0.01 (commercially unacceptable)

Resolution was evaluated based on ease of readability of the text image.

After printing 200,000 sheets as stated above, 3-point and 5-point text images were prepared and evaluated based on the criteria described below.

A: 3-point and 5-point text images were clear and easily read (good)

B: 3-point text images were partially unreadable, while 5-point text images were clear and easily read (commercially acceptable)

C: 3-point text images were barely readable, and 5-point text images also were partly or wholly unreadable (commercially unacceptable)

Cleaning properties were evaluated as follows. After printing 100,000 sheets and 200,000 sheets, 10 A3 sheets were continuously printed and insufficient cleaning was evaluated by inspecting the solid white section.

A: toner was removed until printing 200,000 sheets (good)

B: toner was removed until printing 100,000 sheets (commercially acceptable)

C: toner was not removed prior to printing 100,000 sheets (commercially unacceptable)

White undeveloped spots: After printing 200,000 sheets as above, halftone images were printed on an additional 100 sheets and white undeveloped spots were evaluated.

White undeveloped spots were evaluated based on the number of white undeveloped spots having a longer diameter of at least 0.4 mm per A4 size sheet, of which cyclic formation matched the cyclic rotation of the photoreceptor.

A: number of white undeveloped spots having a size of at least 0.4 mm: at most 3/A4 in all copied images (good)

B: number of white undeveloped spots having a size of at least 0.4 mm: formation on at least one sheet having 4 to 19/A4 (commercially acceptable)

C: number of white undeveloped spots having a size of at least 0.4 mm: formation on at least one sheet having at least 20/A4 (commercially unacceptable)

Black spots were evaluated based on 100 sheets of solid white images which was prepared after printing 200,000 sheets as above.

The number of visible black spots per A4 size of which cyclic formation matched to the cyclic rotation of the photoreceptor was determined for evaluation.

A: number of black spots having a size of at least 0.4 mm: at most 3/A4 in all copied images (good)

B: number of black spots having a size of at least 0.4 mm: formation of at least one sheet having 4 to 19/A4 (commercially acceptable)

C: number of black spots having a size of at least 0.4 mm: formation of at least one sheet having at least 20/A4 (commercially unacceptable)

Cracks

At an ambience of 30° C. and 80 percent relative humidity, the photoreceptor which completed double sided printing of 200,000 sheets remained installing in the digital copier, Konica 7075, and power was turned off. Thereafter, the photoreceptor sat idle for two days. Members around the photoreceptor were kept in the state at which each operation was suspended, namely members such as the cleaning blade, the cleaning roller, and the developer transporting body were kept in contact with the photoreceptor. Thereafter, the presence or absence of cracks on the photoreceptor surface was visually inspected. Further, image formation (for inspection of streak-like images due to formation of cracks on images) was then carried out. Evaluating was performed based on the criteria described below.

A: neither cracks nor streak-like image problems occurred (good)

B: minute cracks occurred, but no streak-like image problems occurred (commercially acceptable)

C: cracks occurred and streak-like image problems also occurred (commercially unacceptable)

Other Evaluation Conditions

Other evaluation conditions, which had been applied to the aforesaid digital copier, Konica 7075, were set as described below.

Charging Conditions

Charging unit: Scorotron charging unit, with an initial setting charge potential of −750 V Exposure Conditions Semiconductor laser at 780 nm was employed as an exposure light source Transfer Conditions Transfer electrode: corona charging system Clenaing Conditions A cleaning section was brought into contact with a cleaning blade having a hardness of 70°, a repulsive elasticity of 65 percent, a thickness of 2 mm, and a free length of 9 mm in the counter direction so as to result in a linear pressure of 18 N/m, employed a weight loading system.

Cleaning roller: A roller was employed of which surface was covered with blown urethane resins.

Table 11 shows the evaluation results.

TABLE 11

| Combination No. | Image Density | Background Stain | Resolution | Cleaning Properties | White Undeveloped Spots | Black Spots | Cracks | Remarks |
|---|---|---|---|---|---|---|---|---|
| 201 | A | A | A | A | A | A | A | Inv. |
| 202 | A | A | A | A | A | A | A | Inv. |
| 203 | A | A | A | A | A | A | A | Inv. |
| 204 | A | A | B | B | B | B | A | Inv. |
| 205 | A | A | B | B | A | B | A | Inv. |
| 206 | A | A | B | A | B | B | A | Inv. |
| 207 | A | A | B | B | A | B | A | Inv. |
| 208 | B | A | B | B | B | B | A | Inv. |
| 209 | B | A | B | B | B | B | A | Inv. |
| 210 | A | A | B | B | A | B | A | Inv. |
| 211 | A | A | B | B | A | B | A | Inv. |
| 212 | B | A | B | B | B | B | A | Inv. |
| 213 | B | A | B | B | B | B | A | Inv. |
| 214 | B | A | B | B | B | B | A | Inv. |
| 215 | B | A | B | B | B | B | A | Inv. |
| 216 | B | A | C | C | C | B | B | |
| 217 | A | A | A | B | B | B | A | Inv. |
| 218 | B | B | B | B | B | B | A | Inv. |
| 219 | A | A | A | A | A | A | A | Inv. |
| 220 | A | A | A | A | A | A | A | Inv. |
| 221 | A | A | B | A | A | A | A | Inv. |
| 222 | B | B | B | B | B | B | B | Inv. |
| 223 | B | B | B | B | B | B | B | Inv. |
| 224 | B | B | C | B | C | C | C | |
| 225 | B | B | C | C | C | C | C | |

As can clearly be seen from Table 11, in the evaluation of the image forming method in which double sided copying was carried out employing the electronic RDH, Combination Nos. 201 through 215 and 217 through 223, which employed the photoreceptor and toner of the present invention, resulted in being equal to or better than commercially available level in evaluation of white undeveloped spots, black spots and cleaning properties, while Combination No. 216 (in which the toner was not included in the present invention), which was not included in the present invention, resulted in a marked increase in white undeveloped spots, degradation of cleaning properties as well as resolution. Combination No. 224 (in which the photoreceptor was not included in the present invention) resulted in a marked increase in white undeveloped spots as well as black spots, cracks, and degradation of cleaning properties as well as degradation of resolution. Further, Combination No. 225 (in which the toner as well as the photoreceptor was not included in the present invention) resulted in formation of both white undeveloped spots and black spots, formation of cracks, and degradation of cleaning properties as well as degradation of resolution. Of Combination Nos. 201 through 215 and 217 through 223 in which the organic photoreceptor and toner of the present invention, Combination Nos. 201 through 215, 217, and 219 through 221 which employed the photoreceptor comprising as a surface layer a charge transport layer comprising the charge transport material, in which the content ratio of the isomer component in the maximum amount occupied in the mixture of stereoisomers was from 40 to 90 percent, resulted in superior improvement effects compared to Combination Nos. 218, 222, and 223 which employed a photoreceptor in which the content ratio was 37.5 and 92.5. Still further, Combinations Nos. 201 through 203, 205 through 207, 210, 211, and 219 through 221, which employed the toner satisfying aforesaid conditions $\hat{2}$ and $\hat{5}$, resulted in better effects than Combination Nos. 204, 208, 212 through 215 which employed the toner which did not satisfy either condition $\hat{2}$ or condition $\hat{5}$.

Particularly, Combination Nos. 201 through 203 and 219 through 221 in which the toner satisfying all the aforesaid conditions $\hat{1}$ through $\hat{5}$ was employed with a photoreceptor comprising, as a surface layer, the charge transport layer comprising the charge transport material, in which the content ratio of the stereoisomer component in the maximum amount occupied in the mixture of stereoisomers was from 40 to 90 percent by weight, resulted in marked minimization of double sided image problems such as white undeveloped spots and black spots, exhibited excellent cleaning properties and also resulted in excellent evaluation for image density as well as resolution.

EXAMPLE 4

Preparation of Photoreceptors 210 through 218

Photoreceptors 210 through 218 were prepared in the same manner as above, except that T20-1 through T20-8 and T20t-t of Photoreceptors 201 through 209 were replaced with T83-1 through T83-8 and T83c-c.

TABLE 12

| Photoreceptor No. | Charge Transport Material | cis-cis/ cis-trans/ trans-trans | Content Ratio of Isomer Component in the Maximum Amount (percent by weight) |
|---|---|---|---|
| Photoreceptor 210 | T83-1 | 1.1/2.2/1.0 | 51 |
| Photoreceptor 211 | T83-2 | 1.7/2.1/1.3 | 41 |
| Photoreceptor 212 | T83-3 | 1.7/1.8/1.3 | 37.5 |
| Photoreceptor 213 | T83-4 | 16.0/3.0/1.0 | 80 |
| Photoreceptor 214 | T83-5 | 1.7/5.0/1.0 | 65 |
| Photoreceptor 215 | T83-6 | 1.7/3.0/37.0 | 88.7 |
| Photoreceptor 216 | T83-7 | 37/1.5/1.5 | 92.5 |
| Photoreceptor 217 | T83-8 | 1.5/37/1.5 | 92.5 |
| Photoreceptor 218 | T83c-c | 1/0/0 | 100 |

Evaluation

The aforesaid Photoreceptors 210 through 218 and Developers 1 through 16 were combined as shown in Table 8, and evaluation was carried out in the same manner as Example 3. Table 13 shows the evaluation results.

TABLE 13

| Combination No. | Photoreceptor No. | Developer No. (Toner No.) |
|---|---|---|
| 31 | 210 | 1 (1) |
| 32 | 210 | 2 (2) |
| 33 | 210 | 3 (3) |
| 34 | 210 | 4 (4) |
| 35 | 210 | 5 (5) |
| 36 | 210 | 6 (6) |
| 37 | 210 | 7 (7) |
| 38 | 210 | 8 (8) |
| 39 | 210 | 9 (9) |
| 40 | 210 | 10 (10) |
| 41 | 210 | 11 (11) |
| 42 | 210 | 12 (12) |
| 43 | 210 | 13 (13) |
| 44 | 210 | 14 (14) |
| 45 | 210 | 15 (15) |
| 46 | 210 | 16 (16) |
| 47 | 211 | 2 (2) |
| 48 | 212 | 2 (2) |
| 49 | 213 | 2 (2) |
| 50 | 214 | 2 (2) |
| 51 | 215 | 2 (2) |
| 52 | 216 | 2 (2) |
| 53 | 217 | 2 (2) |
| 54 | 218 | 2 (2) |
| 55 | 218 | 16 (16) |

TABLE 14

| Combination No. | Image Density | Background Stain | Resolution | Cleaning Properties | White Undeveloped Spots | Black Spots | Cracks | Remarks |
|---|---|---|---|---|---|---|---|---|
| 31 | A | A | A | A | A | A | A | Inv. |
| 32 | A | A | A | A | A | A | A | Inv. |
| 33 | A | A | A | A | A | A | A | Inv. |
| 34 | B | A | B | B | A | B | A | Inv. |
| 35 | A | A | B | B | A | B | A | Inv. |
| 36 | A | A | B | B | B | B | A | Inv. |
| 37 | A | A | B | B | A | B | A | Inv. |
| 38 | B | A | B | B | B | B | A | Inv. |
| 39 | B | A | B | B | B | B | A | Inv. |
| 40 | A | A | B | B | A | B | A | Inv. |
| 41 | A | A | B | B | A | B | A | Inv. |
| 42 | B | A | B | B | B | B | A | Inv. |
| 43 | B | A | B | B | B | B | A | Inv. |
| 44 | B | A | B | B | B | B | A | Inv. |
| 45 | B | A | B | B | B | B | A | Inv. |
| 46 | B | A | C | C | C | B | B | |
| 47 | A | A | A | B | B | B | A | Inv. |
| 48 | B | B | B | B | B | B | A | Inv. |
| 49 | A | A | A | A | A | A | A | Inv. |
| 50 | A | A | A | A | A | A | A | Inv. |
| 51 | A | A | B | A | A | A | A | Inv. |
| 52 | B | B | B | B | B | B | B | Inv. |
| 53 | B | B | B | B | B | B | B | Inv. |
| 54 | B | B | C | B | C | C | C | |
| 55 | C | B | C | C | C | C | C | |

Inv.: Present Invention

As can clearly be seen from Table 14, in the evaluation of the image forming method in which double sided copying was carried out employing the electronic RDH, Combination Nos. 31 through 45 and 47 through 53, which employed the photoreceptor and toner of the present invention, resulted in being equal to or better than at commercially available levels in evaluation of white undeveloped spots, black spots and. cleaning properties, while Combination No. 46 (in which the toner was not included, in the present invention), which was not included in the present invention, resulted in a marked increase in white undeveloped spots, degradation of cleaning properties as well as resolution, and Combination No. 54 (in which the photoreceptor was not included in the present invention) resulted in a marked increase in white undeveloped spots as well as black spots, formation of cracks, and degradation of resolution. Further, Combination No. 55 (in which the toner as well as the photoreceptor was not included in the present invention) resulted in formation of white undeveloped spots as well as black spots, formation of cracks, and degradation of cleaning properties as well as of resolution. Of Combination Nos. 31 through 45 and 47 through 53, which employed the organic photoreceptor and toner of the present invention, Combination Nos. 31 through 45, 47, and 49 through 51, which employed the photoreceptor comprising, as a surface layer, a charge transport layer comprising the charge transport material in which the content ratio of the isomer component in the maximum amount occupied in the mixture of stereoisomers was from 40 to 90 percent, resulted in superior improvement effects compared to Combination Nos. 48, 52, and 53 which employed the photoreceptor in which the content ratio was 37.5 and 92.5. Still further, Combination Nos. 31 through 33, 35 through 37, 40, 41, and 49 through 51, which employed toners which satisfied aforesaid conditions $\hat{2}$ and $\hat{5}$, resulted in better effects than Combination Nos. 34, 38, 39, 42 through 45 which employed the toner which did not satisfy both conditions $\hat{2}$ and $\hat{5}$. Particularly, Combination Nos. 31 through 33 and 49 through 51, which employed the toner satisfying all the aforesaid conditions $\hat{1}$ through $\hat{5}$ in combination with the photoreceptor comprising as a surface layer the charge transport layer comprising the charge transport material, in which the content ratio of the stereoisomer component in the maximum amount occupied in the mixture of stereoisomers was from 40 to 90 percent by weight, markedly minimized double sided image problems such as white undeveloped spots and black spots, exhibited excellent cleaning properties and also resulted in excellent evaluation for image density as well as resolution.

As can clearly be seen from examples described above, the image forming method, in which the organic photoreceptor and toner of the present invention were employed, was capable of minimizing image problems, such as white undeveloped spots and black spots, which are not compatible with each other, minimizing cracks, exhibiting excellent cleaning properties and forming electrophotographic images with excellent resolution, even when double sided image forming method is employed under marked variation of temperature as well as humidity around the photoreceptor, while employing an electronic RDH.

The invention claimed is:

1. An image forming method for forming an image on both sides of a sheet, comprising:

forming a first toner image on a photoreceptor;

transferring the first toner image to a first side of a sheet;

fixing the first toner image on the sheet with a fixing device;

returning the sheet from the fixing device to the photoreceptor without stacking the sheet on an intermediate tray while forming a second toner image on the photoreceptor;

transferring the second toner image on the photoreceptor to a second side of the sheet;

fixing the second toner image on the sheet with the fixing device, wherein the photoreceptor comprising an electrically conductive support having thereon a charge generating layer and a charge transport layer, and the charge transport layer comprises a charge transport material comprising a mixture of stereoisomers as a charge transport material and a binder resin wherein glass transition point Tgb of the binder resin of the charge transport layer and glass transition point Tgl of the charge transport layer satisfy the relationship;

$100°\ C. < Tgl < Tgb$ (both $Tgb$ and $Tgl$ in °C.); and wherein molecular weight of the charge transport material comprising a mixture of stereoisomers is from 600 to 1,500.

2. The image forming method of claim 1 wherein the binder resin in the charge transport layer comprises polycarbonate.

3. The image forming method of claim 1 which has an interlayer between the electrically conductive support and the charge generating layer.

4. The image forming method of claim 3 wherein the interlayer comprise a binder resin in which minute inorganic particles are dispersed.

5. The image forming method of claim 1, wherein the fixing device is a thermal fixing device.

6. The image forming method of claim 1, wherein the toner has a variation coefficient of the shape factor of toner particles of at most 16 percent.

7. The image forming method of claim 1, wherein the toner comprises toner particles having a shape coefficient in the range of 1.2 to 1.6 of 65 percent by number.

8. The image forming method of claim 1, wherein the toner comprises toner particles without corners at a ratio of at least 50 percent by number.

9. The image forming method of claim 1, wherein the toner is such that sum M of $m_1$ and $m_2$ is at least 70 percent, wherein $m_1$ is the relative frequency of toner particles included in the highest frequency class in a histogram, showing the particle size distribution based on the number of particles, in which, when D (in μm) represents the diameter of a toner particle, natural logarithm 1nD is taken as the absicissa and a plurality of classes at an interval of 0.23 is taken as the ordinate, and $m_2$ is the relative frequency of toner particles included in the second highest frequency qiass in the histogram.

10. The image forming method of claim 1, wherein the toner has a number variation coefficient of toner particles of at most 27 percent.

11. The image forming method of claim 1, wherein the content ratio of the isomer which occupies the greatest proportion in the mixture of stereoisomers is from 40 to 90 percent by weight.

12. The image forming method of claim 1, wherein the toner is a polymerization toner.

13. The image forming method of claim 1, wherein the number average particle diameter of the toner is from 3.0 to 8.5 μm.

* * * * *